US010971000B2

(12) United States Patent
Margulici et al.

(10) Patent No.: US 10,971,000 B2
(45) **Date of Patent: *Apr. 6, 2021**

(54) ESTIMATING TIME TRAVEL DISTRIBUTIONS ON SIGNALIZED ARTERIALS

(71) Applicant: Uber Technologies, Inc., San Francisco, CA (US)

(72) Inventors: J. D. Margulici, Santa Clara, CA (US); Kevin Adda, Santa Clara, CA (US); André Guéziec, Sunnyvale, CA (US); Edgar Rojas, Santa Clara, CA (US)

(73) Assignee: Uber Technologies, Inc., San Francisco, CA (US)

( * ) Notice: Subject to any disclaimer, the term of this patent is extended or adjusted under 35 U.S.C. 154(b) by 73 days.

This patent is subject to a terminal disclaimer.

(21) Appl. No.: 16/195,439

(22) Filed: Nov. 19, 2018

(65) Prior Publication Data

US 2019/0164417 A1 May 30, 2019

Related U.S. Application Data

(60) Division of application No. 14/058,195, filed on Oct. 18, 2013, now Pat. No. 10,223,909, which is a (Continued)

(51) Int. Cl.
*G08G 1/01* (2006.01)

(52) U.S. Cl.
CPC ..... *G08G 1/0112* (2013.01); *G08G 1/0116* (2013.01); *G08G 1/0129* (2013.01)

(58) Field of Classification Search
CPC ... G08G 1/0112; G08G 1/0116; G08G 1/0129
See application file for complete search history.

(56) References Cited

U.S. PATENT DOCUMENTS 4,734,863 A 3/1988 Honey et al.
4,788,645 A 11/1988 Zavoli et al.
(Continued)

FOREIGN PATENT DOCUMENTS

CA 2883973 A1 8/2013
CO 6710924 A2 7/2013
(Continued)

OTHER PUBLICATIONS

US 9,019,260 B2, 04/2015, Gueziec et al. (withdrawn)
(Continued)

*Primary Examiner* — Hussein Elchanti
(74) *Attorney, Agent, or Firm* — Schwegman Lundberg & Woessner, P.A.

(57) ABSTRACT

Systems and methods are provided for estimating time travel distributions on signalized arterials. The systems and methods may be implemented as or through a network service. Traffic data regarding a plurality of travel times on a signalized arterial may be received. A present distribution of the travel times on the signalized arterial may be determined. A prior distribution based on one or more travel time observations may also be determined. The present distribution may be calibrated based on the prior distribution.

19 Claims, 27 Drawing Sheets

Related U.S. Application Data continuation-in-part of application No. 13/752,351, filed on Jan. 28, 2013, now Pat. No. 8,781,718.

(60) Provisional application No. 61/715,713, filed on Oct. 18, 2012.

(56) References Cited

U.S. PATENT DOCUMENTS

| | | | |
|---|---|---|---|
| 4,792,803 | A | 12/1988 | Madnick et al. |
| 4,796,191 | A | 1/1989 | Honey et al. |
| 4,878,170 | A | 10/1989 | Zeevi |
| 4,914,605 | A | 4/1990 | Loughmiller, Jr. et al. |
| 4,926,343 | A | 5/1990 | Tsuruta et al. |
| 5,068,656 | A | 11/1991 | Sutherland |
| 5,086,510 | A | 2/1992 | Guenther et al. |
| 5,095,532 | A | 3/1992 | Mardus |
| 5,126,941 | A | 6/1992 | Gurmu et al. |
| 5,164,904 | A | 11/1992 | Sumner |
| 5,173,691 | A | 12/1992 | Sumner |
| 5,182,555 | A | 1/1993 | Sumner |
| 5,220,507 | A | 6/1993 | Kirson |
| 5,247,439 | A | 9/1993 | Gurmu et al. |
| 5,262,775 | A | 11/1993 | Tamai et al. |
| 5,276,785 | A | 1/1994 | Mackinlay et al. |
| 5,283,575 | A | 2/1994 | Kao et al. |
| 5,291,412 | A | 3/1994 | Tamai et al. |
| 5,291,413 | A | 3/1994 | Tamai et al. |
| 5,291,414 | A | 3/1994 | Tamai et al. |
| 5,297,028 | A | 3/1994 | Ishikawa |
| 5,297,049 | A | 3/1994 | Gurmu et al. |
| 5,303,159 | A | 4/1994 | Tamai et al. |
| 5,311,195 | A | 5/1994 | Mathis et al. |
| 5,311,434 | A | 5/1994 | Tamai |
| 5,339,246 | A | 8/1994 | Kao |
| 5,343,400 | A | 8/1994 | Ishikawa |
| 5,345,382 | A | 9/1994 | Kao |
| 5,359,529 | A | 10/1994 | Snider |
| 5,374,933 | A | 12/1994 | Kao |
| 5,377,113 | A | 12/1994 | Shibazaki et al. |
| 5,390,123 | A | 2/1995 | Ishikawa |
| 5,394,333 | A | 2/1995 | Kao |
| 5,402,120 | A | 3/1995 | Fujii et al. |
| 5,414,630 | A | 5/1995 | Oshizawa et al. |
| 5,428,545 | A | 6/1995 | Maegawa et al. |
| 5,430,655 | A | 7/1995 | Adachi |
| 5,440,484 | A | 8/1995 | Kao |
| 5,465,079 | A | 11/1995 | Bouchard et al. |
| 5,477,220 | A | 12/1995 | Ishikawa |
| 5,485,161 | A | 1/1996 | Vaughn |
| 5,488,559 | A | 1/1996 | Seymour |
| 5,499,182 | A | 3/1996 | Ousborne |
| 5,504,482 | A | 4/1996 | Schreder |
| 5,508,931 | A | 4/1996 | Snider |
| 5,515,283 | A | 5/1996 | Desai et al. |
| 5,515,284 | A | 5/1996 | Abe |
| 5,539,645 | A | 7/1996 | Mandhyan et al. |
| 5,546,107 | A | 8/1996 | Deretsky et al. |
| 5,548,822 | A | 8/1996 | Yogo |
| 5,550,538 | A | 8/1996 | Fujii et al. |
| 5,554,845 | A | 9/1996 | Russell |
| 5,583,972 | A | 12/1996 | Miller |
| 5,608,635 | A | 3/1997 | Tamai |
| 5,610,821 | A | 3/1997 | Gazis et al. |
| 5,689,252 | A | 11/1997 | Ayanoglu et al. |
| 5,694,534 | A | 12/1997 | White, Jr. et al. |
| 5,699,056 | A | 12/1997 | Yoshida |
| 5,706,503 | A | 1/1998 | Poppen et al. |
| 5,712,788 | A | 1/1998 | Liaw et al. |
| 5,729,458 | A | 3/1998 | Poppen |
| 5,731,978 | A | 3/1998 | Tamai et al. |
| 5,742,922 | A | 4/1998 | Kim |
| 5,751,245 | A | 5/1998 | Janky et al. |
| 5,751,246 | A | 5/1998 | Hertel |
| 5,757,359 | A | 5/1998 | Morimoto et al. |
| 5,774,827 | A | 6/1998 | Smith, Jr. et al. |
| 5,818,356 | A | 10/1998 | Schuessler |
| 5,822,712 | A | 10/1998 | Olsson |
| 5,842,142 | A | 11/1998 | Murray et al. |
| 5,845,227 | A | 12/1998 | Peterson |
| 5,850,190 | A | 12/1998 | Wicks et al. |
| 5,862,244 | A | 1/1999 | Kleiner et al. |
| 5,862,509 | A | 1/1999 | Desai et al. |
| 5,864,305 | A | 1/1999 | Rosenquist |
| 5,867,110 | A | 2/1999 | Naito et al. |
| 5,893,081 | A | 4/1999 | Poppen |
| 5,893,898 | A | 4/1999 | Tanimoto |
| 5,898,390 | A | 4/1999 | Oshizawa et al. |
| 5,902,350 | A | 5/1999 | Tamai et al. |
| 5,904,728 | A | 5/1999 | Tamai et al. |
| 5,908,464 | A | 6/1999 | Kishigami et al. |
| 5,910,177 | A | 6/1999 | Zuber |
| 5,911,773 | A | 6/1999 | Mutsuga et al. |
| 5,912,635 | A | 6/1999 | Oshizawa et al. |
| 5,916,299 | A | 6/1999 | Poppen |
| 5,922,042 | A | 7/1999 | Sekine et al. |
| 5,928,307 | A | 7/1999 | Oshizawa et al. |
| 5,931,888 | A | 8/1999 | Hiyokawa |
| 5,933,100 | A | 8/1999 | Golding |
| 5,938,720 | A | 8/1999 | Tamai |
| 5,948,043 | A | 9/1999 | Mathis |
| 5,978,730 | A | 11/1999 | Poppen et al. |
| 5,982,298 | A | 11/1999 | Lappenbusch et al. |
| 5,987,381 | A | 11/1999 | Oshizawa |
| 5,991,687 | A | 11/1999 | Hale et al. |
| 5,999,882 | A | 12/1999 | Simpson et al. |
| 6,009,374 | A | 12/1999 | Urahashi |
| 6,011,494 | A | 1/2000 | Watanabe et al. |
| 6,016,485 | A | 1/2000 | Amakawa et al. |
| 6,021,406 | A | 2/2000 | Kuznetsov |
| 6,038,509 | A | 3/2000 | Poppen et al. |
| 6,058,390 | A | 5/2000 | Liaw et al. |
| 6,064,970 | A | 5/2000 | McMillan et al. |
| 6,091,359 | A | 7/2000 | Geier |
| 6,091,956 | A | 7/2000 | Hollenberg |
| 6,097,399 | A | 8/2000 | Bhatt et al. |
| 6,111,521 | A | 8/2000 | Mulder et al. |
| 6,144,919 | A | 11/2000 | Ceylan et al. |
| 6,147,626 | A | 11/2000 | Sakakibara |
| 6,150,961 | A | 11/2000 | Alewine et al. |
| 6,161,092 | A | 12/2000 | Latshaw |
| 6,169,552 | B1 | 1/2001 | Endo et al. |
| 6,188,956 | B1 | 2/2001 | Walters |
| 6,209,026 | B1 | 3/2001 | Ran et al. |
| 6,222,485 | B1 | 4/2001 | Walters et al. |
| 6,226,591 | B1 | 5/2001 | Okumura et al. |
| 6,236,933 | B1 | 5/2001 | Lang |
| 6,253,146 | B1 | 6/2001 | Hanson et al. |
| 6,253,154 | B1 | 6/2001 | Oshizawa et al. |
| 6,256,577 | B1 | 7/2001 | Graunke |
| 6,259,987 | B1 | 7/2001 | Ceylan et al. |
| 6,282,486 | B1 | 8/2001 | Bates et al. |
| 6,282,496 | B1 | 8/2001 | Chowdhary |
| 6,292,745 | B1 | 9/2001 | Robare et al. |
| 6,295,492 | B1 | 9/2001 | Lang et al. |
| 6,297,748 | B1 | 10/2001 | Lappenbusch et al. |
| 6,298,305 | B1 | 10/2001 | Kadaba et al. |
| 6,317,685 | B1 | 11/2001 | Kozak et al. |
| 6,317,686 | B1 | 11/2001 | Ran |
| 6,335,765 | B1 | 1/2002 | Daly et al. |
| 6,353,795 | B1 | 3/2002 | Ranjan |
| 6,356,836 | B1 | 3/2002 | Adolph |
| 6,360,165 | B1 | 3/2002 | Chowdhary |
| 6,360,168 | B1 | 3/2002 | Shimabara |
| 6,362,778 | B2 | 3/2002 | Neher |
| 6,415,291 | B2 | 7/2002 | Bouve et al. |
| 6,424,910 | B1 | 7/2002 | Ohler et al. |
| 6,442,615 | B1 | 8/2002 | Nordenstam et al. |
| 6,456,931 | B1 | 9/2002 | Polidi et al. |
| 6,456,935 | B1 | 9/2002 | Ng |
| 6,463,400 | B1 | 10/2002 | Barkley-yeung |
| 6,466,862 | B1 | 10/2002 | Dekock et al. |
| 6,470,268 | B1 | 10/2002 | Ashcraft et al. |
| 6,473,000 | B1 | 10/2002 | Secreet et al. |
| 6,480,783 | B1 | 11/2002 | Myr |

(56) References Cited

U.S. PATENT DOCUMENTS 6,504,541 B1 1/2003 Liu et al.
6,526,335 B1 2/2003 Treyz et al.
6,529,143 B2 3/2003 Mikkola et al.
6,532,304 B1 3/2003 Liu et al.
6,539,302 B1 3/2003 Bender et al.
6,542,814 B2 4/2003 Polidi et al.
6,552,656 B2 4/2003 Polidi et al.
6,556,905 B1 4/2003 Mittelsteadt et al.
6,559,865 B1 5/2003 Angwin
6,574,548 B2 6/2003 Dekock et al.
6,584,400 B2 6/2003 Beardsworth
6,594,576 B2 7/2003 Fan et al.
6,598,016 B1 7/2003 Zavoli et al.
6,600,994 B1 7/2003 Polidi
6,603,405 B2 8/2003 Smith
6,622,086 B2 9/2003 Polidi
6,639,550 B2 10/2003 Knockeart et al.
6,643,581 B2 11/2003 Ooishi
6,650,948 B1 11/2003 Atkinson et al.
6,650,997 B2 11/2003 Funk
6,654,681 B1 11/2003 Kiendl et al.
6,675,085 B2 1/2004 Straub
6,681,176 B2 1/2004 Funk et al.
6,687,615 B1 2/2004 Krull et al.
6,700,503 B2 3/2004 Masar et al.
6,710,774 B1 3/2004 Kawasaki et al.
6,720,889 B2 4/2004 Yamaki et al.
6,728,605 B2 4/2004 Lash et al.
6,728,628 B2 4/2004 Peterson
6,731,940 B1 5/2004 Nagendran
6,735,516 B1 5/2004 Manson
6,754,833 B1 6/2004 Black et al.
6,785,606 B2 8/2004 Dekock et al.
6,791,472 B1 9/2004 Hoffberg
6,807,483 B1 10/2004 Chao et al.
6,845,316 B2 1/2005 Yates
6,859,728 B2 2/2005 Sakamoto et al.
6,862,524 B1 3/2005 Nagda et al.
RE38,724 E 4/2005 Peterson
6,885,937 B1 4/2005 Suranyi
6,901,330 B1 5/2005 Krull et al.
6,914,541 B1 7/2005 Zierden
6,922,629 B2 7/2005 Yoshikawa et al.
6,931,309 B2 8/2005 Phelan et al.
6,952,643 B2 10/2005 Matsuoka et al.
6,965,665 B2 11/2005 Fan et al.
6,983,204 B2 1/2006 Knutson
6,987,964 B2 1/2006 Obradovich et al.
6,989,765 B2 1/2006 Gueziec
6,999,873 B1 2/2006 Krull et al.
7,010,583 B1 3/2006 Aizono et al.
7,062,378 B2 6/2006 Krull et al.
7,069,143 B2 6/2006 Peterson
7,103,854 B2 9/2006 Fuchs et al.
7,133,767 B2 * 11/2006 Ogino ..... G01C 21/26 701/400
7,161,497 B2 1/2007 Gueziec
7,209,828 B2 4/2007 Katou
7,221,287 B2 5/2007 Gueziec et al.
7,243,134 B2 7/2007 Bruner et al.
7,343,242 B2 3/2008 Breitenberger et al.
7,356,392 B2 4/2008 Hubbard et al.
7,375,649 B2 5/2008 Gueziec
7,424,388 B2 9/2008 Sato
7,433,676 B2 10/2008 Kobayashi et al.
7,440,842 B1 10/2008 Vorona
7,486,201 B2 2/2009 Kelly et al.
7,508,321 B2 3/2009 Gueziec et al.
7,557,730 B2 7/2009 Gueziec
7,558,674 B1 7/2009 Neilley et al.
7,603,138 B2 10/2009 Zhang et al.
7,610,145 B2 10/2009 Kantarjiev et al.
7,613,564 B2 11/2009 Vorona
7,634,352 B2 12/2009 Soulchin et al.
7,702,452 B2 4/2010 Kantarjiev et al.
7,725,348 B1 * 5/2010 Allen ..... G07B 15/063 705/13
7,765,056 B2 * 7/2010 Cattin ..... G08G 1/042 340/933
7,792,642 B1 9/2010 Neilley et al.
7,835,858 B2 11/2010 Smyth et al.
7,847,708 B1 12/2010 Jones et al.
7,880,642 B2 2/2011 Gueziec
7,908,076 B2 3/2011 Downs et al.
7,912,627 B2 * 3/2011 Downs ..... G08G 1/0112 701/117
8,024,111 B1 9/2011 Meadows et al.
8,103,443 B2 1/2012 Kantarjiev et al.
8,229,658 B1 7/2012 Dabell
8,358,222 B2 1/2013 Gueziec
8,428,856 B2 4/2013 Tischer
8,531,312 B2 9/2013 Gueziec
8,537,033 B2 9/2013 Gueziec
8,564,455 B2 10/2013 Gueziec
8,618,954 B2 12/2013 Free
8,619,072 B2 12/2013 Guéziec et al.
8,660,780 B2 2/2014 Kantarjiev et al.
8,718,910 B2 5/2014 Guéziec
8,725,396 B2 5/2014 Gueziec et al.
8,781,718 B2 * 7/2014 Margulici ..... G08G 1/0112 701/119
8,786,464 B2 7/2014 Gueziec
8,825,356 B2 9/2014 Vorona
8,958,988 B2 2/2015 Gueziec
8,965,695 B2 2/2015 Tzamaloukas
8,972,171 B1 3/2015 Barth
8,982,116 B2 3/2015 Guéziec et al.
8,983,426 B2 * 3/2015 Cermak ..... G06Q 10/10 455/405
9,002,636 B2 4/2015 Udeshi et al.
9,046,924 B2 6/2015 Gueziec et al.
9,070,291 B2 6/2015 Gueziec
9,082,303 B2 7/2015 Gueziec
9,127,959 B2 9/2015 Kantarjiev et al.
9,158,980 B1 10/2015 Ferguson et al.
9,293,039 B2 3/2016 Margulici et al.
9,368,029 B2 6/2016 Gueziec
9,390,620 B2 7/2016 Gueziec et al.
9,401,088 B2 7/2016 Gueziec
9,448,690 B2 9/2016 Gueziec et al.
9,489,842 B2 11/2016 Gueziec
10,223,909 B2 * 3/2019 Margulici ..... G08G 1/0112
2001/0005809 A1 6/2001 Ito
2001/0014848 A1 8/2001 Walgers et al.
2001/0018628 A1 8/2001 Jenkins et al.
2001/0026276 A1 10/2001 Sakamoto et al.
2001/0033225 A1 10/2001 Razavi et al.
2001/0047242 A1 11/2001 Ohta
2001/0049424 A1 12/2001 Petiniot et al.
2002/0022923 A1 2/2002 Hirabayashi et al.
2002/0042819 A1 4/2002 Reichert et al.
2002/0077748 A1 6/2002 Nakano
2002/0152020 A1 10/2002 Seibel
2002/0177947 A1 11/2002 Cayford
2003/0009277 A1 1/2003 Fan et al.
2003/0046158 A1 3/2003 Kratky
2003/0055558 A1 3/2003 Watanabe et al.
2003/0109985 A1 6/2003 Kotzin
2003/0135304 A1 7/2003 Sroub et al.
2003/0151592 A1 8/2003 Ritter
2003/0182052 A1 9/2003 Delorme et al.
2004/0034464 A1 2/2004 Yoshikawa et al.
2004/0046759 A1 3/2004 Soulchin et al.
2004/0049424 A1 3/2004 Murray et al.
2004/0080624 A1 4/2004 Yuen
2004/0107288 A1 6/2004 Menninger et al.
2004/0143385 A1 7/2004 Smyth et al.
2004/0166939 A1 8/2004 Leifer et al.
2004/0225437 A1 11/2004 Endo et al.
2004/0249568 A1 12/2004 Endo et al.
2005/0021225 A1 1/2005 Kantarjiev et al.
2005/0027436 A1 2/2005 Yoshikawa et al.
2005/0083325 A1 4/2005 Cho
2005/0099321 A1 5/2005 Pearce

(56) References Cited

U.S. PATENT DOCUMENTS

| | | | |
|---|---|---|---|
| 2005/0143902 | A1 | 6/2005 | Soulchin et al. |
| 2005/0154505 | A1 | 7/2005 | Nakamura et al. |
| 2005/0212756 | A1 | 9/2005 | Marvit et al. |
| 2005/0240340 | A1 | 10/2005 | Ishikawa et al. |
| 2006/0074546 | A1 | 4/2006 | Dekock et al. |
| 2006/0122846 | A1 | 6/2006 | Burr et al. |
| 2006/0136846 | A1 | 6/2006 | Im et al. |
| 2006/0143959 | A1 | 7/2006 | Stehle et al. |
| 2006/0145892 | A1 | 7/2006 | Gueziec |
| 2006/0158330 | A1 | 7/2006 | Gueziec |
| 2006/0238521 | A1 | 10/2006 | Westerman et al. |
| 2006/0238617 | A1 | 10/2006 | Tamir |
| 2006/0284766 | A1 | 12/2006 | Gruchala et al. |
| 2007/0009156 | A1 | 1/2007 | O'hara et al. |
| 2007/0013551 | A1 | 1/2007 | Gueziec |
| 2007/0038362 | A1 | 2/2007 | Gueziec |
| 2007/0060384 | A1 | 3/2007 | Dohta |
| 2007/0066394 | A1 | 3/2007 | Ikeda et al. |
| 2007/0115252 | A1 | 5/2007 | Burgmans |
| 2007/0142995 | A1 | 6/2007 | Wotlermann |
| 2007/0197217 | A1 | 8/2007 | Sutardja |
| 2007/0208494 | A1 | 9/2007 | Chapman et al. |
| 2007/0208495 | A1 | 9/2007 | Chapman et al. |
| 2007/0208496 | A1 | 9/2007 | Downs et al. |
| 2007/0211026 | A1 | 9/2007 | Ohta |
| 2007/0211027 | A1 | 9/2007 | Ohta |
| 2007/0222750 | A1 | 9/2007 | Ohta |
| 2007/0247291 | A1 | 10/2007 | Masuda et al. |
| 2007/0265766 | A1 | 11/2007 | Jung et al. |
| 2008/0014908 | A1 | 1/2008 | Vasant |
| 2008/0021632 | A1 | 1/2008 | Amano |
| 2008/0071465 | A1 | 3/2008 | Chapman et al. |
| 2008/0084385 | A1 | 4/2008 | Ranta et al. |
| 2008/0096654 | A1 | 4/2008 | Mondesir et al. |
| 2008/0133120 | A1 | 6/2008 | Romanick |
| 2008/0248848 | A1 | 10/2008 | Rippy et al. |
| 2008/0255754 | A1 | 10/2008 | Pinto |
| 2008/0287189 | A1 | 11/2008 | Rabin |
| 2008/0297488 | A1 | 12/2008 | Operowsky et al. |
| 2009/0005965 | A1 | 1/2009 | Forstall et al. |
| 2009/0061971 | A1 | 3/2009 | Weitzner et al. |
| 2009/0066495 | A1 | 3/2009 | Newhouse et al. |
| 2009/0082950 | A1 | 3/2009 | Vorona |
| 2009/0096753 | A1 | 4/2009 | Lim |
| 2009/0112465 | A1 | 4/2009 | Weiss et al. |
| 2009/0118017 | A1 | 5/2009 | Perlman et al. |
| 2009/0118996 | A1 | 5/2009 | Kantarjiev et al. |
| 2009/0189979 | A1 | 7/2009 | Smyth |
| 2009/0192702 | A1 | 7/2009 | Bourne |
| 2009/0254272 | A1 | 10/2009 | Hendrey |
| 2010/0036594 | A1 | 2/2010 | Yamane et al. |
| 2010/0045517 | A1 | 2/2010 | Tucker et al. |
| 2010/0079306 | A1 | 4/2010 | Liu et al. |
| 2010/0094531 | A1 | 4/2010 | Macleod |
| 2010/0100307 | A1 | 4/2010 | Kim |
| 2010/0145569 | A1 | 6/2010 | Bourque et al. |
| 2010/0145608 | A1 | 6/2010 | Kurtti et al. |
| 2010/0164753 | A1 | 7/2010 | Free |
| 2010/0175006 | A1 | 7/2010 | Li |
| 2010/0194632 | A1 | 8/2010 | Raento et al. |
| 2010/0198453 | A1 | 8/2010 | Dorogusker et al. |
| 2010/0225643 | A1 | 9/2010 | Gueziec et al. |
| 2010/0305839 | A1 | 12/2010 | Wenzel |
| 2010/0312462 | A1 | 12/2010 | Guéziec et al. |
| 2010/0333045 | A1 | 12/2010 | Guéziec et al. |
| 2011/0029189 | A1 | 2/2011 | Hyde et al. |
| 2011/0037619 | A1 | 2/2011 | Ginsberg et al. |
| 2011/0106427 | A1 | 5/2011 | Kim et al. |
| 2011/0161261 | A1 | 6/2011 | Wu et al. |
| 2011/0304447 | A1 | 12/2011 | Marumoto |
| 2012/0044066 | A1 | 2/2012 | Mauderer et al. |
| 2012/0065871 | A1 | 3/2012 | Deshpande et al. |
| 2012/0072096 | A1 | 3/2012 | Chapman et al. |
| 2012/0123667 | A1 | 5/2012 | Guéziec |
| 2012/0150422 | A1 | 6/2012 | Kantarjiev et al. |
| 2012/0150425 | A1 | 6/2012 | Chapman et al. |
| 2012/0158275 | A1 | 6/2012 | Huang et al. |
| 2012/0226434 | A1 | 9/2012 | Chiu |
| 2012/0290202 | A1 | 11/2012 | Gueziec et al. |
| 2012/0290204 | A1 | 11/2012 | Gueziec |
| 2012/0296559 | A1 | 11/2012 | Guéziec et al. |
| 2013/0033385 | A1 | 2/2013 | Gueziec |
| 2013/0204514 | A1 | 8/2013 | Margulici et al. |
| 2013/0207817 | A1 | 8/2013 | Gueziec |
| 2013/0211701 | A1 | 8/2013 | Baker et al. |
| 2013/0297175 | A1 | 11/2013 | Davidson |
| 2013/0304347 | A1 | 11/2013 | Davidson |
| 2013/0304349 | A1 | 11/2013 | Davidson |
| 2014/0088871 | A1 | 3/2014 | Gueziec |
| 2014/0091950 | A1 | 4/2014 | Gueziec |
| 2014/0107923 | A1 | 4/2014 | Gueziec |
| 2014/0129124 | A1 | 5/2014 | Margulici et al. |
| 2014/0129142 | A1 | 5/2014 | Kantarjiev et al. |
| 2014/0139520 | A1 | 5/2014 | Gueziec et al. |
| 2014/0200807 | A1 | 7/2014 | Geisberger |
| 2014/0236464 | A1 | 8/2014 | Gueziec |
| 2014/0249734 | A1 | 9/2014 | Gueziec et al. |
| 2014/0316688 | A1 | 10/2014 | Margulici et al. |
| 2014/0320315 | A1 | 10/2014 | Gueziec |
| 2015/0081196 | A1 | 3/2015 | Petty et al. |
| 2015/0141043 | A1 | 5/2015 | Abramson et al. |
| 2015/0168174 | A1 | 6/2015 | Abramson et al. |
| 2015/0168175 | A1 | 6/2015 | Abramson et al. |
| 2015/0177018 | A1 | 6/2015 | Gueziec et al. |
| 2015/0248795 | A1 | 9/2015 | Davidson |
| 2015/0261308 | A1 | 9/2015 | Gueziec et al. |
| 2015/0268055 | A1 | 9/2015 | Gueziec |
| 2015/0268056 | A1 | 9/2015 | Gueziec |
| 2015/0325123 | A1 | 11/2015 | Gueziec |
| 2016/0047667 | A1 | 2/2016 | Kantarjiev et al. |
| 2016/0267788 | A1 | 9/2016 | Margulici et al. |
| 2016/0302047 | A1 | 10/2016 | Gueziec |
| 2016/0321918 | A1 | 11/2016 | Guéziec et al. |
| 2016/0335893 | A1 | 11/2016 | Gueziec |

FOREIGN PATENT DOCUMENTS

| | | | |
|---|---|---|---|
| DE | 19856704 | A1 | 6/2000 |
| EP | 0680648 | A1 | 11/1995 |
| EP | 0749103 | A1 | 12/1996 |
| EP | 0987665 | A2 | 3/2000 |
| EP | 1006367 | A2 | 6/2000 |
| EP | 1235195 | A2 | 8/2002 |
| EP | 2178061 | A1 | 4/2010 |
| EP | 2616910 | A1 | 7/2013 |
| EP | 2635989 | A2 | 9/2013 |
| EP | 2638493 | A2 | 9/2013 |
| EP | 2710571 | A2 | 3/2014 |
| EP | 2820631 | A1 | 1/2015 |
| EP | 2820631 | | 1/2019 |
| GB | 2400293 | A | 10/2004 |
| JP | 05313578 | A | 11/1993 |
| JP | 0877485 | A | 3/1996 |
| JP | 10261188 | A | 9/1998 |
| JP | 10281782 | A | 10/1998 |
| JP | 10293533 | A | 11/1998 |
| JP | 2000055675 | A | 2/2000 |
| JP | 2000113387 | A | 4/2000 |
| JP | 2001330451 | A | 11/2001 |
| WO | WO-9636929 | A1 | 11/1996 |
| WO | WO-1996036929 | A1 | 11/1996 |
| WO | WO-9823018 | A1 | 5/1998 |
| WO | WO-0050917 | A1 | 8/2000 |
| WO | WO-0188480 | A1 | 11/2001 |
| WO | WO-0277921 | A2 | 10/2002 |
| WO | WO-03014671 | A1 | 2/2003 |
| WO | WO-2005013063 | A2 | 2/2005 |
| WO | WO-2005076031 | A2 | 8/2005 |
| WO | WO-2010073053 | A1 | 7/2010 |
| WO | WO-2012024694 | A2 | 2/2012 |
| WO | WO-2012037287 | A1 | 3/2012 |
| WO | WO-2012065188 | A2 | 5/2012 |

(56) References Cited

FOREIGN PATENT DOCUMENTS

| | | | |
|---|---|---|---|
| WO | WO-2012159083 | A2 | 11/2012 |
| WO | WO-2012037287 | | 3/2013 |
| WO | WO-2013113029 | A1 | 8/2013 |

OTHER PUBLICATIONS

"2002 Urban Mobility Study: 220 Mobility Issues and Measures: The Effects of Incidents—Crashes and Vehicle Breakdowns", Texas Transportation Institute, (2002).
"Acura Debuts Acuralink™ Satellite-Linked Communication System with Industry's First Standard Real Time Traffic Feature at New York International Auto Show", (2004), 4 pgs.
"Amended Answer and Counterclaims of TomTom", Inc. to Plaintiff *Triangle Software, LLC's* Complaint for Patent Infringement, (Mar. 6, 2011).
"Answer and Counterclaims of TomTom", Inc. to Plaintiff *Triangle Software, LLC's* Complaint for Patent Infringement, (May 16, 2011), 42 pgs.
"Answer, Affirmative Defenses, and Counterclaims by Defendant Westwood One", Inc., to Plaintiff *Triangle Software LLC's* Complaint for Patent Infringement, (Mar. 11, 2011).
"U.S. Appl. No. 10/379,967, Final Office Action dated May 11, 2005", 10 pgs.
"U.S. Appl. No. 10/379,967, Non Final Office Action dated Sep. 20, 2004", 9 pgs.
"U.S. Appl. No. 10/897,550, Non Final Office Action dated Jan. 21, 2009", 7 pgs.
"U.S. Appl. No. 10/897,550, Non Final Office Action dated Jun. 12, 2009", 5 pgs.
"U.S. Appl. No. 10/897,550, Non Final Office Action dated Aug. 1, 2008", 6 pgs.
"U.S. Appl. No. 10/897,550, Non Final Office Action dated Oct. 3, 2007", 7 pgs.
"U.S. Appl. No. 11/509,954, Non Final Office Action dated Nov. 23, 2007", 9 pgs.
"U.S. Appl. No. 11/751,628, Non Final Office Action dated Jan. 29, 2009", 6 pgs.
"U.S. Appl. No. 12/283,748, Non Final Office Action dated Mar. 11, 2009", 7 pgs.
"U.S. Appl. No. 12/283,748, Non Final Office Action dated Aug. 20, 2009", 5 pgs.
"U.S. Appl. No. 12/398,120, Final Office Action dated Mar. 26, 2013", 23 pgs.
"U.S. Appl. No. 12/398,120, Final Office Action dated Apr. 12, 2012", 29 pgs.
"U.S. Appl. No. 12/398,120, Non Final Office Action dated Nov. 14, 2012", 39 pgs.
"U.S. Appl. No. 12/398,120, Non Final Office Action dated Nov. 15, 2011", 23 pgs.
"U.S. Appl. No. 12/763,199, Final Office Action dated Nov. 1, 2010", 7 pgs.
"U.S. Appl. No. 12/763,199, Non Final Office Action dated Aug. 5, 2010", 5 pgs.
"U.S. Appl. No. 12/860,700, Final Office Action dated Jun. 26, 2013", 47 pgs.
"U.S. Appl. No. 12/860,700, Final Office Action dated Jul. 22, 2014", 64 pgs.
"U.S. Appl. No. 12/860,700, Non Final Office Action dated Feb. 26, 2013", 44 pgs.
"U.S. Appl. No. 12/860,700, Non Final Office Action dated Apr. 3, 2014", 59 pgs.
"U.S. Appl. No. 12/881,690, Final Office Action dated May 21, 2014", 18 pgs.
"U.S. Appl. No. 12/881,690, Final Office Action dated Aug. 9, 2013", 19 pgs.
"U.S. Appl. No. 12/881,690, Non Final Office Action dated Jan. 9, 2014", 15 pgs.
"U.S. Appl. No. 12/881,690, Non Final Office Action dated Apr. 22, 2013", 19 pgs.
"U.S. Appl. No. 12/881,690, Non Final Office Action dated Sep. 3, 2014", 17 pgs.
"U.S. Appl. No. 12/967,045, Final Office Action dated Jun. 27, 2012", 5 pgs.
"U.S. Appl. No. 12/967,045, Non Final Office Action dated Jul. 18, 2011", 7 pgs.
"U.S. Appl. No. 13/296,108, Final Office Action dated Oct. 25, 2013", 10 pgs.
"U.S. Appl. No. 13/296,108, Non Final Office Action dated May 9, 2013", 10 pgs.
"U.S. Appl. No. 13/316,250, Final Office Action dated Jun. 24, 2013", 7 pgs.
"U.S. Appl. No. 13/316,250, Non Final Office Action dated Jan. 18, 2013", 6 pgs.
"U.S. Appl. No. 13/475,502, Final Office Action dated Sep. 10, 2013", 11 pgs.
"U.S. Appl. No. 13/475,502, Non Final Office Action dated Apr. 22, 2013", 7 pgs.
"U.S. Appl. No. 13/561,269, Non Final Office Action dated Dec. 13, 2012", 7 pgs.
"U.S. Appl. No. 13/561,327, Non Final Office Action dated Oct. 26, 2012", 8 pgs.
"U.S. Appl. No. 13/747,454, Non Final Office Action dated Jun. 17, 2013", 5 pgs.
"U.S. Appl. No. 13/752,351, Non Final Office Action dated Jul. 22, 2013", 5 pgs.
"U.S. Appl. No. 13/752,351, Notice of Allowance dated Feb. 21, 2014", 5 pgs.
"U.S. Appl. No. 13/752,351, Notice of Allowance dated May 27, 2014", 2 pgs.
"U.S. Appl. No. 13/752,351, Notice of Allowance dated Nov. 12, 2013", 7 pgs.
"U.S. Appl. No. 13/752,351, Response filed Oct. 22, 2013 to Non Final Office Action dated Jul. 22, 2013", 6 pgs.
"U.S. Appl. No. 14/053,195, Respnse filed Jul. 10, 2018 to Non Final Office Action dated Apr. 10, 2018", 7 pgs.
"U.S. Appl. No. 14/058,195, Advisory Action dated Jun. 24, 2015", 2 pgs.
"U.S. Appl. No. 14/058,195, Final Office Action dated Mar. 1, 2016", 5 pgs.
"U.S. Appl. No. 14/058,195, Final Office Action dated Apr. 8, 2015", 8 pgs.
"U.S. Appl. No. 14/058,195, Non Final Office Action dated Apr. 10, 2018", 5 pgs.
"U.S. Appl. No. 14/058,195, Non Final Office Action dated Aug. 4, 2015", 7 pgs.
"U.S. Appl. No. 14/058,195, Non Final Office Action dated Nov. 12, 2014", 8 pgs.
"U.S. Appl. No. 14/058,195, Notice of Allowance dated Aug. 13, 2018", 8 pgs.
"U.S. Appl. No. 14/058,195, Preliminary Amendment filed Jan. 21, 2014", 4 pgs.
"U.S. Appl. No. 14/058,195, Response filed Jan. 25, 2016 to Non Final Office Action dated Aug. 4, 2015", 9 pgs.
"U.S. Appl. No. 14/058,195, Response filed Mar. 12, 2015 to Non Final Office Action dated Nov. 12, 2014", 8 pgs.
"U.S. Appl. No. 14/058,195, Response filed Jun. 8, 2015 to Final Office Action dated Apr. 8, 2015", 9 pgs.
"U.S. Appl. No. 14/058,195, Response filed Oct. 30, 2014 to Restriction Requirement dated Sep. 30, 2014", 5 pgs.
"U.S. Appl. No. 14/058,195, Response filed Dec. 29, 2016 to Final Office Action dated Mar. 1, 2016", 9 pgs.
"U.S. Appl. No. 14/058,195, Restriction Requirement dated Sep. 30, 2014", 5 pgs.
"U.S. Appl. No. 14/100,985, Final Office Action dated Mar. 25, 2015", 35 pgs.
"U.S. Appl. No. 14/100,985, Non Final Office Action dated Sep. 23, 2014", 43 pgs.
"U.S. Appl. No. 14/100,985, Non Final Office Action dated Oct. 1, 2015", 39 pgs.

(56) References Cited

OTHER PUBLICATIONS

"U.S. Appl. No. 14/265,290, Final Office Action dated Jan. 29, 2016", 14 pgs.
"U.S. Appl. No. 14/265,290, Final Office Action dated Oct. 19, 2016", 16 pgs.
"U.S. Appl. No. 14/265,290, Non Final Office Action dated May 31, 2016", 7 pgs.
"U.S. Appl. No. 14/265,290, Non Final Office Action dated Jul. 23, 2015", 10 pgs.
"U.S. Appl. No. 14/275,702, Non Final Office Action dated Nov. 30, 2015", 10 pgs.
"U.S. Appl. No. 14/323,352, Final Office Action dated Apr. 3, 2015", 6 pgs.
"U.S. Appl. No. 14/323,352, Non Final Office Action dated Nov. 26, 2014", 7 pgs.
"U.S. Appl. No. 14/323,352, Notice of Allowance dated Nov. 13, 2015", 6 pgs.
"U.S. Appl. No. 14/323,352, Response filed Feb. 26, 2015 to Non Final Office Action dated Nov. 26, 2014", 3 pgs.
"U.S. Appl. No. 14/323,352, Response filed Oct. 2, 2015 to Final Office Action dated Apr. 3, 2015", 3 pgs.
"U.S. Appl. No. 14/323,352, Supplemental Notice of Allowability dated Feb. 3, 2016", 2 pgs.
"U.S. Appl. No. 14/323,352, Supplemental Notice of Allowability dated Dec. 8, 2015", 2 pgs.
"U.S. Appl. No. 14/327,468, Final Office Action dated Aug. 4, 2015", 6 pgs.
"U.S. Appl. No. 14/327,468, Non Final Office Action dated Mar. 12, 2015", 8 pgs.
"U.S. Appl. No. 14/624,498, Non Final Office Action dated Feb. 18, 2016", 6 pgs.
"U.S. Appl. No. 14/637,357, Non Final Office Action dated Aug. 23, 2016", 29 pgs.
"U.S. Appl. No. 14/726,858, Final Office Action dated Sep. 8, 2016", 19 pgs.
"U.S. Appl. No. 14/726,858, Non Final Office Action Feb. 22, 2016", 17 pgs.
"U.S. Appl. No. 15/077,880, Non Final Office Action dated Jul. 21, 2016", 8 pgs.
"U.S. Appl. No. 15/077,880, Notice of Non-Compliant Amendment dated Feb. 2, 2017", 6 pgs.
"U.S. Appl. No. 15/077,880, Preliminary Amendment filed Jun. 2, 2016", 6 pgs.
"U.S. Appl. No. 15/077,880, Response filed Dec. 21, 2016 to Non Final Office Action dated Jul. 21, 2016", 9 pgs.
"U.S. Appl. No. 15/181,221, Non Final Office Action dated Aug. 11, 2016", 7 pgs.
"Attachment A of Garmin's Preliminary Invalidity Contentions and Certificate of Service filed May 16, 2011 in *Triangle Software", LLC.* V. *Garmin International, Inc. et al.,* Case No. 1: 10-cv-1457-CMH-TCB in the United States District Court for the Eastern District of Virginia, Alexandria Division, 6 pgs.
"Attachment B of Garmin's Preliminary Invalidity Contentions and Certificate of Service filed May 16, 2011 in *Triangle Software", LLC.* V. *Garmin International, Inc. et al.,* Case No. 1: 10-cv-1457-CMH-TCB in the United States District Court for the Eastern District of Virginia, Alexandria Division, 618 pgs.
"Audi-V150 Manual", Japan, (Oct. 2001), 152 pgs.
"Birdview Navigation System by Nissan Motor Corp", 240 Landmarks of Japanese Automotive Technology, Society of Automotive Engineers of Japan, Inc., Japan., (1995), 2 pgs.
"Canadian Application Serial No. 2,688,129, Office Action dated Jan. 18, 2016", 5 pgs.
"Carin Navigation System Manual and Service Manual for Model Carin 22SY520", Philips Car Systems, The Netherlands, [date unknown], 76 pgs.
"Closing the Data Gap: Guidelines for Quality Advanced Traveler Information System (ATIS) Data", Closing the Data Gap, Version 1.0, (Sep. 2000), 41 pgs.
"Declaration Under 37 C.F.R. 1.131 and Source Code from U.S. Appl. No. 10/897,550", filed Oct. 27, 2008.
"European Application Serial No. 11825897.9, Communication dated May 3, 2013", 2 pgs.
"European Application Serial No. 12785688.8, Extended European Search Report dated Aug. 12, 2015", 11 pgs.
"European Application Serial No. 13740931.4, Extended European Search Report dated Apr. 19, 2016", 9 pgs.
"European Application Serial No. 13740931.4, Response filed May 11, 2015 to Communication pursuant to Rules 161(2) and 162 EPC dated Feb. 24, 2015", 6 pgs.
"European Application Serial No. 13740931.4, Response filed Nov. 7, 2016 to Extended European Search Report dated Apr. 19, 2016", 21 pgs.
"European Application Serial No. 1740931.4, Extended European Search Report dated Apr. 19, 2016", 10 pgs.
"Expert Report of Dr. Michael Goodchild Concerning the Validity of U.S. Pat. No. 5,938,720 dated Jun. 16, 2011 in *Triangle Software", LLC* v. *Garmin International Inc. et al.,* in the United States District Court for the Eastern District of Virginia, Alexandria Division Case No. 1:10-cv-1457-CMH-TCB, 16 pgs.
"*Garmin International, Inc.* and *Garmin USA, Inc.'s* Answer and Counterclaim to Triangle Software, LLC's Supplemental Complaints filed Jun. 17, 2011 in *Triangle Software", LLC* v. *Garmin International Inc. et al.,* in the United States District Court for the Eastern District of Virainia, Alexandria Division, Case No. 1 :10-cv-1457-CMH-TCB, 36 pgs.
"Garmin International, Inc.'s Amended Answer and Counterclaims to Triangle Software", LLC's Complaint, (Mar. 16, 2011).
"Garmin International, Inc.'s Answer and Counterclaims to Triangle Software", LLC's Complaint, (Feb. 24, 2011).
"Garmin's Preliminary Invalidity Contentions and Certificate of Service filed May 16, 2011 in *Triangle Software", LLC.* v. *Garmin International, Inc. et al.,* Case No. 1: 10-cv-1457-CMH-TCB in the United States District Court for the Eastern District of Virginia, Alexandria Division, 46 pgs.
"GM Exhibits Prototype of TravTek Test Vehicle", Inside IVHS V. 1, No. 21, (Oct. 28, 1991), 2 pgs.
"Initial Expert Report of Roy Summer dated Jun. 16, 2011 in *Triangle Software", LLC* v. *Garmin International Inc. et al.,* in the United States District Court for the Eastern District of Virginia, Alexandria Division, Case No. 1 :10-cv-1457-CMH-TCB, 289 pgs.
"Initial Expert Report of William R. Michelson, PH.D. dated Jun. 17, 2011 in *Triangle Software", LLC* v. *Garmin International Inc. et al.,* in the United States District Court for the Eastern District of Virginia, Alexandria Division Case No. 1 :10-cv-1457-CM H-TCB, 198 pgs.
"International Application Serial No. PCT/US2004/23884, International Search Report dated Jun. 17, 2005", 1 pg.
"International Application Serial No. PCT/US2004/23884, Written Opinion dated Jun. 17, 2005", 3 pgs.
"International Application Serial No. PCT/US2011/48680, International Search Report dated Feb. 7, 2012", 2 pgs.
"International Application Serial No. PCT/US2011/48680, Written Opinion dated Feb. 7, 2012", 4 pgs.
"International Application Serial No. PCT/US2011/51647, International Search Report dated Feb. 2, 2012", 2 pgs.
"International Application Serial No. PCT/US2011/51647, Written Opinion dated Feb. 2, 2012", 4 pgs.
"International Application Serial No. PCT/US2011/60663, International Search Report dated May 31, 2012", 3 pgs.
"International Application Serial No. PCT/US2011/60663, Written Opinion dated May 31, 2012", 4 pgs.
"International Application Serial No. PCT/US2012/38702, International Search Report dated Aug. 24, 2012", 2 pgs.
"International Application Serial No. PCT/US2012/38702, Written Opinion dated Aug. 24, 2012", 4 pgs.
"International Application Serial No. PCT/US2013/023505, International Preliminary Report on Patentability dated Aug. 7, 2014", 5 pgs.
"International Application Serial No. PCT/US2013/023505, International Search Report dated May 10, 2013", 2 pgs.

(56) References Cited

OTHER PUBLICATIONS

"International Application Serial No. PCT/US2013/023505, Written Opinion dated May 10, 2013", 3 pgs.
"International Application Serial No. PCT/US2013/23505, International Search Report dated May 10, 2013", 2 pgs.
"International Application Serial No. PCT/US2013/23505, Written Opinion dated May 10, 2013", 3 pgs.
"Meridian Series of GPS Receivers User Manual", Magellan Thales Navigation, Inc., San Dimas, CA, USA., (2002), 106 pgs.
"N'FIT Xanavi", Japana, (May 17, 2013), 94 pgs.
"Nintendo Wii Operations Manual Systems Setup", (2009).
"Nissan Automobile Navigation System User Manual", 163 pgs.
"Panasonic Portable Navigation System User Manual for Products KX-GT30", KX-GT30X and KX-GT30Z, Matsushita Denki Sangyo K.K., Fukuoka City, Japan, 1-5, 132-147.
"Preliminary Invalidity Contentions of Defendant TomTom", Inc., Certificate of Service and Exhibit A filed May 16, 2011 in *Triangle Software, LLC.* v. *Garmin International, Inc. et al.,* Case No. 1: 10-cv-1457-CMH-TCB in the United States District Court for the Eastern District of Virginia, Alexandria Division, 354 pgs.
"Reference Manual for the Magellan RoadMate 500/700", Thales Navigation, Inc., San Dimas, CA, USA., (2003), 65 pgs.
"Sirius Satellite Radio: Traffic Development Kit Start Up Guide", Version 00.00.01, NY, New York,, (Sep. 27, 2005), 14 pgs.
"Supplemental Expert Report of William R. Michelson, PH.D. Regarding Invalidity of the Patents-in-Suit dated Jul. 5, 2011 in *Triangle Software", LLC* v. *Garmin International Inc. et al.,* in the United States District Court for the Eastern District of Virginia, Alexandria Division, Case No. 1 :1 O-cv-1457-CM H-TCB, 23 pgs.
"The Challenge of VICS: The Dialog Between the Car and Road has Begun", The Road Traffic Information Communication System Centre (VICS Centre), Tokyo, Japan., (Oct. 1, 1996), 19-63.
"TRAVTEK Information and Services Center Policy/Procedures Manual", U.S. Department of Transportation, Mclean, VA, USA., (Feb. 1992), 133 pgs.
"TrueView Interactive Training Manual, Showfx Student Guide", WSI Document Version: 4.3x., [Online] Retrieved from the Internet : <http://apollo.lsc.vsc.edu/intranet/WSIShowfx/traininq/970-TVSK-SG-43.pdf>, (Sep. 2004).
"User Guide of Tom Tom ONE", (2006).
"Volkswagen Group of America", Inc.'s Answer and Counterclaim, (Feb. 24, 2011).
"XM Radio Introduces Satellite Update Service for Vehicle Navigation", (Apr. 8, 2004), 2 pgs.
Adib, Kanafani, "Towards a Technology Assessment of Highway Navigation and Route Guidance", Program on Advanced Technology for the Highway, Institute of Transportation Studies, University of California, Berkeley PATH Working Paper UCB-ITS-PWP, (Dec. 1987), 87-6.
Balke, K N, "Advanced Technologies for Communicating with Motorists: A Synthesis of Human Factors and Traffic Management Issues", Report No. FHW A/TX-92/1232-8, Texas Department Transportation, Austin, TX, USA,, (May 1992), 62 pgs.
Barnaby, J Feder, "Talking Deals; Big Partners in Technology", Technology, The New York Times, (Sep. 3, 1987).
Benjamin, Coifman, "Improved Vehicle Reidentification and Travel Time Measurement on Congested Freeways", Journal of Transportation Engineering,, (Oct. 1, 1999), 475-483.
Blumentritt, K, et al., "Travel System Architecture Evaluation", Publication No. FHWA-RD-96-141, U.S. Department of Transportation, Mclean, VA, USA., (Jul. 1995), 504 pgs.
Brooks, et al., "Turn-by-Turn Displays versus Electronic Maps: An On-the-Road Comparison of Driver Glance Behavior", Technical Report, The University of Michigan, Transportation Research Institute (UMTRI), (Jan. 1999).
Burgett, A L, "Safety Evaluation of TravTek", Vehicle Navigation & Information Systems Conference Proceedings (VNIS'91 ), p. 253, Part 1, Soc. of Automotive Engineers, Inc., Warrendale, PA, USA., (Oct. 1991), 819-825.
Campbell, J L, "Development of Human Factors Design Guidelines for Advanced Traveler Information Systems (ATIS)", Proceedings Vehicle Navigation and Information Systems Conference, IEEE, New York, NY, USA, (1995), 161-164.
Campbell, J L, "Development of Human Factors Design Guidelines for Advanced Traveler Information Systems (ATIS) and Commercial Vehicle Operations (CVO)", Publication No. FHWA-RD-98-057, U.S. Department of Transportation, Mclean, VA 22010-2296, (Sep. 1998), 294 pgs.
Cathey, F W, et al., "A Prescription for Transit Arrival/Department Prediction Using Automatic Vehicle Location Data", Transportation Research Part C 11, Pergamon Press Ltd., Elsevier Ltd., U.K., (2003), 241-264.
Chien, S I, et al., "Predicting Travel Times for the South Jersey Real-Time Motorist Information System", Transportation Research Record 1855, Paper No. 03-2750, (Oct. 2001), 32-40.
Chira-Chavala, T, et al., "Feasibility Study of Advanced Technology HOV Systems", vol. 3: Benefit Implications of Alternative Policies for Including HOV lanes in Route Guidance Networks, UCB-ITS-PRR-92-5 PATH Research Report, Inst. of Transportation Studies, Univ. of Calif., Berkeley, USA., (Dec. 1992), 84 pgs.
Clark, E L, "Development of Human Factors Guidelines for Advanced Traveler Information Systems (ATIS) and Commercial Vehicle Operations (CVO): Comparable Systems Analysis", (Dec. 1996), 199 pgs.
Coifman, Benjamin, "Vehicle Reidentification and Travel Time Measurement on Congested Freeways", Journal of Transportation Engineering, (Oct. 1, 1999), 475-483.
Dancer, F, et al., "Vehicle Navigation Systems: Is America Ready?", Navigation and Intelligent Transportation System, Automotive Electronics Series, Society of Automotive Engineers, (1998), 3-8.
Davies, P, et al., "Assessment of Advanced Technologies for Relieving Urban Traffic Congestion", National Cooperative Highway Research Program Report 340, (Dec. 1991), 106 pgs.
De, Cambray B, "Three-Dimensional (3D) Modeling in a Geographical Database", Auto-Carto'11, Eleventh International Conference on Computer Assisted Cartography Minneapolis, USA., (Nov. 1, 1993), 338-347.
Dillenburg, J F, et al., "The Intelligent Travel Assistant", IEEE 5th International Conference on Intelligent Transportation Systems Singapore, (Sep. 3-6, 2002), 691-696.
Dingus, T A, et al., "Human Factors Engineering the TravTek Driver Interface", Vehicle Navigation & Information System Conference Proceedings (VNIS'91), p. 253, Part 2, Soc. Of Automotive Engineers, Inc., Warrendale, PA, USA., (Oct. 1991), 749-755.
Endo, et al., "Development and Evaluation of a Car Navigation System Providing a Birds Eye View Map Display", Navigation and Intelligent Transportation Systems, Automotive Electronics Series, Society of Automotive Engineers, (1998), 19-22.
Eppinger, A, et al., "Dynamic Route Guidance—Status and Trends", Convergence 2000 International Congress on Transportation Electronics, Detroit, MI, SAE International Paper Series, Warrendale, PA, USA., (Oct 16-18, 1999), 7 pgs.
Fawcett, J, "Adaptive Routing for Road Traffic", IEEE Computer Graphics and Applications, IEEE, New York, NY, USA, (May/Jun. 2000), 46-53.
Fleischman, R N, "Research and Evaluation Plans for the TravTek IVHS Operational Field Test", Vehicle Navigation & Information Systems Conference Proceedings (VNIS'91), p. 253, Part 2 Soc. Of Automotive Engineers, Inc., Warrendale, PA, USA., (Oct. 1991), 827-837.
Goldberg, et al., "Computing the Shortest Path: A* Search Meets Graph Theory", Proc. of the 16th Annual ACM-SIAM Sym. on Discrete Algorithms, Vancouver, BC., (Jan. 23-25, 2005), Feb. 18, 2014.
Goldberg, et al., "Computing the Shortest Path: A* Search Meets Graph Theory", Microsoft Research, Technical Report MSR-TR-2004, (Mar. 24, 2003).
Golisch, F, "Navigation and Telematics in Japan", International Symposium on Car Navigation Systems, Barcelona, Spain, (May 21, 1997), 20 pgs.
Gueziec, A, "Architecture of a System for Producing Animated Traffic Reports", (Mar. 30, 2011), 42 pgs.

(56) References Cited

OTHER PUBLICATIONS

Gueziec, Andre, "3D Traffic Visualization in Real Time", ACM Siggraph Technical Sketches, Conference Abstracts and Application Los Angeles, CA,, (Aug. 2001), p. 144.
Handley, S, et al., "Learning to Predict the Duration of an Automobile Trip", Proceedings of the Fourth International Conference on Knowledge Discovery and Data Mining, AAAI Press, New York, NY, USA., (1998), 5 pgs.
Hankey, et al., "In-Vehicle Information Systems Behavioral Model and Design Support: Final Report", Publication No. 00-135, Research, Development, and Technology, Turner-Fairbank Hiahway Research Center, Mclean, Virginia, (Feb. 16, 2000).
Hirata, et al., "The Development of a New Multi-AV System Incorporating an On-Board Navigation Function", International Congress and Exposition, held in Detroit, MI, SAE International, Warrendale, PA, USA., (Mar. 1-5, 1993), 1-12.
Hoffmann, G, et al., "Travel Times as a Basic Part of the LISB Guidance Strategy", Third International Conference on Road Traffic Control, London, U.K., (May 1-3, 1990), 6-10.
Hoffmann, T, "2005 Acura RL Prototype Preview", [Online] Retrieved from the Internet : <Auto123.com>, 4 pgs.
Hu, Z, et al., "Real-time Data Fusion on Tracking Camera Pose for Direct Visual Guidance", IEEE Vehicles Symposium, (Jun. 14-17, 2004), 842-847.
Huang, et al., "Experimental Analysis and Modeling of Route Choice with the Revealed and Stated Preference Data", Journal of the Eastern Asia Society for Transportation Studies, vol. 3, No. 6, (Sep. 1999).
Hulse, M C, et al., "Development of Human Factors Guidelines for Advanced Traveler Information Systems and Commercial Vehicle Operations: Identification of the Strengths and Weaknesses of Alternative Information Display Formats", Publication No. FHWA-RD—Office of Safety and Traffic Operation R&D, Federal Highway Administration, USA., (Oct. 16, 1998), 187 pgs.
Inman, V W, et al., "TravTek Evaluation Rental and Local User Study", Publication No. FHWA-RD-96-028, U.S. Department of Transportation, Mclean, VA, USA., (Mar. 1996), 110 pgs.
Inman, V W, et al., "TravTek Global Evaluation and Executive Summary", Publication No. FHWA-RD-96-031 U.S. Department of Transportation, Mclean, VA, USA., (Mar. 1996), 104 pgs.
Jiang, G, "Travel-Time Prediction for Urban Arterial Road: A Case on China", Proceedings Intelligent Transportation Systems, IEEE, New York, NY, USA., (Oct. 12-15, 2003), 255-260.
Karabassi, A, et al., "Vehicle Route Prediction and Time and Arrival Estimation Techniques for Improved Transportation System Management", in Proceedings of the Intelligent Vehicles Symposium, IEEE, New York, NY, USA, (2003), 511-516.
Koller, D, et al., "Virtual GIS: A Real-Time 3D Geographic Information System", Proceedings of the 6th IEEE Visualization Conference (Visualization 95) IEEE, New York, NY, USA., (1995), 94-100.
Kopitz, et al., "Table of Contents, Chapter 6, Traffic Information Services, and Chapter 7, Intelligent Transport Systems and RDS-TMC in RDS: The Radio Data System", Back Cover page, Artech House Publishers, Boston, USA and London, Great Britain., (1992), 107-167.
Krage, M K, "The TravTek Driver Information System", Vehicle Navigation & Information Systems Conference Proceedings (VN IS'91),p. 253, Part 1,Soc. Of Automotive Engineers, Inc., Warrendale, PA, USA., (Oct. 1991), 739-748.
Ladner, R, et al., "3D Mapping of Interactive Synthetic Environment", Computing Practices, IEEE, New York, NY, USA., (Mar. 2000), 33-39.
Levinson, D, "Assessing the Benefits and Costs of Intelligent Transportation Systems: The Value of Advanced Traveler Information System", Publication UCB-ITS-PRR-99-20, California Path Program Institute of Transportation Studies, University of California, Berkeley, CA, USA., (Jul. 1999).
Lowenau, J, "Final Map Actualisation Requirements", Version 1.1, ActMAP Consortium,, (Sep. 30, 2004), 111 pgs.
Ness, M, "A Prototype Low Cost In-Vehicle Navigation System", IEEE-IEE Vehicle Navigation & Information Systems Conference (VNIS), New York, NY, USA., (1993), 56-59.
Noonan, J, "Intelligent Transportation Systems Field Operational Test Cross-Cutting Study Advanced Traveler Information Systems", U.S. Department of Transportation, Mclean, VA, USA., (Sep. 1998), 27 pgs.
Odagaki, et al., "Automobile Navigation System with Multi-Source Guide Information", International Congress & Exposition, SAE International, Warrendale, PA, USA., (Feb. 24-28, 1992), 97-105.
Raper, J F, "Three-Dimensional GIS", in Geographical Information Systems: Principles and Applications vol. 1, Chapter 20, (1991), 21 pgs.
Riiett, L R, "Simulating the TravTek Route Guidance Logic Using the Integration Traffic Model", Vehicle Navigation & Information System, p. 253, Part 2, Soc. of Automotive Engineers, Inc., Warrendale, PA, USA., (Oct. 1991), 775-787.
Rillings, J H, "Advanced Driver Information Systems", IEEE Transactions on Vehicular Technology, vol. 40, No. 1, IEEE, New York, NY, USA, (Feb. 1991), 31-40.
Rillings, J H, "TravTek", Vehicle Navigation & Information System Conference Proceedings (VN IS'91), p. 253, Part 2, Soc. of Automotive Engineers, Inc., Warrendale, PA, USA., (Oct. 1991), 729-737.
Rockwell, Mark, "Telematics Speed Zone Ahead", Wireless Week, Reed Business Information, [Online] Retrieved from the Internet : <http://www.wirelessweek.com>, (Jun. 15, 2004).
Rupert, R L, "The TravTek Traffic Management Center and Traffic Information Network", Vehicle Navigation & Information System Conference Proceedings (VN IS'91 ), p. 253, Part 1, Soc. Of Automotive Engineers, Inc., Warrendale, PA, USA., (Oct. 1991), 757-761.
Schofer, J L, "Behavioral Issues in the Design and Evaluation of Advanced Traveler Information Systems", Transportation Research Part C 1, Pergamon Press Ltd., Elsevier Science Ltd., (1993), 107-117.
Schulz, W, "Traffic Management Improvement by Integrating Modem Communication Systems", IEEE Communications Magazine New York, NY, USA., (Oct. 1996), 56-60.
Shepard, L.D H, "Information Integration and GIS", in Geographical Information Systems: Principles and Applications, vol. 1, (1991), 337-360.
Slothhower, D, "Sketches & Applications", SIGGRAPH Stanford University., (2001), 138-144.
Sumner, R, "Data Fusion in Pathfinder and TravTek", Part 1, Vehicle Navigation & Information Systems Conference Proceedings (VN IS'91) Cover & Title page,, (Oct. 1991), 71-75.
Tamuara, et al., "Toward Realization of VICS—Vehicle Information and Communications System", IEEE-IEE Vehicle Navigation & Information Systems Conference (VNIS'93), Ottawa, Canada, (1993), 72-77.
Taylor, K B, "TravTek-Information and Services Center", Vehicle Navigation & Information System Conference Proceedings (VN IS'91) p. 253, Part 2,Soc. Of Automotive Engineers, Inc., Warrendale, PA, USA., (Oct. 1991), 763-774.
Thompson, S M, "Exploiting Telecommunications to Delivery Real Time Transport Information", Road Transport Information and Control, Conf. Publication No. 454, IEE, U.K., (Apr. 21-23, 1998), 59-63.
Tonjes, R, "3D Reconstruction of Objects from Ariel Images Using a GIS", presented at ISPRS Workshops on Theoretical and Practical Aspects of Surface Reconstructions and 3-D Object Extraction Haifa, Israel, (Sep. 9-11, 1997), 8 pgs.
Truett, R, "Car Navigation System May Live on After Test", The Orlando Sentinel, (Feb. 17, 1993), 3 pgs.
Vollmer, R, "Navigation Systems—Intelligent Co-Drivers with Knowledge of Road and Tourist Information", Navigation and Intelligent Transportation Systems, Automotive Electronics Series, Society of Automotive Engineers, (1998), 9-17.
Watanabe, M, et al., "Development and Evaluation of a Car Navigation System Providing a Bird's-Eye View Map Display", Technical Paper No. 961007, SAE International, (Feb. 1, 1996), 11-18.

(56) References Cited

OTHER PUBLICATIONS

Wischhof, L, et al., "SOTIS—A Self-Organizing Traffic Information System", Proceedings of the 57th IEEE Vehicular Technology Conference (VTC—03), New York, NY, USA., (2003), 2442-2446.
Yang, Qi, "A Simulation Laboratory for Evaluation of Dynamic Traffic Management Systems", Massachusetts Institute of Technology, (Jun. 1997).
Yim, et al., "Evaluation of TravInfo Field Operation Test", TravInfo. Field Operational Test Evaluation, (Apr. 25, 2000).
Yim, et al., "TravInfo Field Operational Test Evaluation: Information Service Providers Customer Survey", (May 1, 2000).
Yokouchi, K, "Car-Navigation Systems", Mitsubishi Electr. Adv. Technical Reports, vol. 91, Japan, (2000), 10-14.
You, J, et al., "Development and Evaluation of a Hybrid Travel Time Forecasting Model", Transportation Research Pare C 9, Pergamon Press Ltd., Elsevier Science Ltd., U.K., (2000), 231-256.
Zhao, Y, "Vehicle Location and Navigation Systems", Arthech House,Inc., Norwood, MA, USA., (1997), 370 pgs.
Zhu, C, et al., "3D Terrain Visualization for Web GIS", Center for Advance Media Technology, Nanyang Technological University, Singapore, (2003), 8 pgs.
"Canadian Application Serial No. 2,883,973, Response filed Jun. 13, 2019 to Examiner's Rule 30(2) Requisition dated Dec. 13, 2018", 9 pgs.
"European Application Serial No. 18191898.8, Response filed Jul. 23, 2019 to Extended European Search Report dated Dec. 3, 2018", 17 pgs.
"European Application Serial No. 18191898.8, Extended European Search Report dated Dec. 3, 2018", 8 pgs.
"European Application Serial No. 18191898.8, Communication Pursuant to Article 94(3) EPC dated Nov. 22, 2019", 4 pgs.
"U.S. Appl. No. 14/058,195, Notice of Allowability dated Feb. 1, 2019", 2 pgs.
"U.S. Appl. No. 14/058,195, Notice of Allowability dated Dec. 20, 2018", 2 pgs.
"Canadian Application Serial No. 2,883,973, Examiner's Rule 30(2) Requisition dated Dec. 13, 2018", 4 pgs.
"European Application Serial No. 18191898.8, Response filed Mar. 19, 2020 to Communication Pursuant to Aritcle 94(3) EPC dated Nov. 22, 2019", 2 pgs.
U.S. Appl. No. 13/752,351 U.S. Pat. No. 8,781,718, filed Jan. 28, 2013, Estimating Time Travel Distributions on Signalized Arterials.
U.S. Appl. No. 14/323,352 U.S. Pat. No. 9,293,039, filed Jul. 3, 2014, Estimating Time Travel Distributions on Signalized Arterials.
U.S. Appl. No. 15/077,880, filed Mar. 22, 2016, Estimating Time Travel Distributions on Signalized Arterials.
U.S. Appl. No. 14/058,195, filed Oct. 18, 2013, Estimating Time Travel Distributions on Signalized Arterials.

* cited by examiner

SEGMENT LENGTH: 1.388 km MEDIAN SAMPLE SIZE: 745

TIME-OF-DAY DISTRIBUTIONS OF THE PACE IN 15-MIN PERIOD OVER 30 DAYS

Seg. length: 1.388 km Med. samp. size: 73 # samples: 21

ESTIMATING TIME TRAVEL DISTRIBUTIONS ON SIGNALIZED ARTERIALS

CROSS-REFERENCE TO RELATED APPLICATION

This application is a divisional of U.S. Application No. 14/058,195, filed on Oct. 18, 2013 and entitled "Estimating Time Travel Distributions on Signalized Arterials," now issued as U.S. Patent No. 10,223,909, which is a continuation-in-part of U.S. Application No. 13/752,351, filed on Jan. 28, 2013 and entitled "Estimating Time Travel Distributions on Signalized Arterials," now issued as U.S. Patent No. 8,781,718, which claims the priority benefit of U.S. Provisional Application No. 61/715,713, filed on Oct. 18, 2012 and entitled "Estimation of Time Travel Distributions on Signalized Arterials," each of which is incorporated herein by reference.

BACKGROUND

Field of Invention

The present disclosure generally concerns traffic management. More specifically, the present disclosure concerns estimating time travel distributions on signalized arterials and thoroughfares.

Description of Related Art

Systems for estimating traffic conditions have historically focused on highways. Highways carry a majority of all vehicle-miles traveled on roads and are instrumented with traffic detectors. Notably, highways lack traffic signals (i.e., they are not "signalized"). Estimating traffic conditions on signalized streets represents a far greater challenge for two main reasons. First, traffic flows are interrupted because vehicles must stop at signalized intersections. These interruptions generate complex traffic patterns. Second, instrumentation amongst signalized arterials is sparse because the low traffic volumes make such instrumentation difficult to justify economically.

In recent years, however, global positioning system (GPS) connected devices have become a viable alternative to traditional traffic detectors for collecting data. As a result of the permeation of GPS connected devices, travel information services now commonly offer information related to arterial conditions. For example, travel information services provided by Google Inc. of Mountain View, Calif. and Inrix, Inc. of Kirkland, Wash., are known at this time. Although such information is frequently available, the actual quality of the traffic estimations provided remains dubious.

Even the most cursory of comparisons between information from multiple service providers reveals glaring differences in approximated signalized arterial traffic conditions. The low quality of such estimations is usually a result of having been produced from a limited set of observations. Recent efforts, however, have sought to increase data collection by using re-identification technologies.

Such techniques have been based on be based on magnetic signatures, toll tags, license plates, or embedded devices. The sampling sizes obtained from such technologies are orders of magnitude greater than those obtained from mobile GPS units. Sensys Networks, Inc. of Berkeley, Calif., for example, collects arterial travel time data using magnetic re-identification and yields sampling rates of up to 50%. Notwithstanding these recently improved observation techniques, there remains a need to provide more accurate estimates of traffic conditions on signalized arterials.

SUMMARY

A system for estimating time travel distributions on signalized arterials may include a processor, memory, and an application stored in memory. The application may be executable by the processor to receive data regarding travel times on a signalized arterial, estimate a present distribution of the travel times, estimate a prior distribution based on one or more travel time observations, and calibrate the present distribution based on the prior distribution. In some embodiments, the system may further include estimating traffic conditions for a particular signalized arterial segment and displaying the estimates to a user through a graphical interface of a mobile device.

A method for estimating time travel distributions on signalized arterials may include receiving travel data and executing instructions stored in memory. Execution of the instructions by a computer processor may estimate a distribution based on the travel data and calibrate the distribution. In some embodiments, the method may further include estimating traffic conditions for a particular signalized arterial segment and displaying the estimates to a user through a graphical interface of a mobile device.

DETAILED DESCRIPTION

Figure 1:
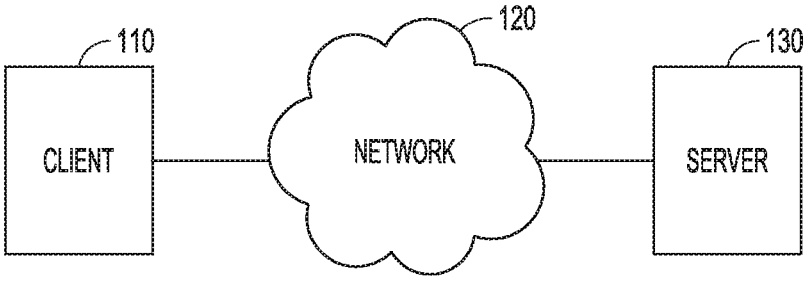
FIG. 1 is a block diagram of a system for estimating time travel distributions on signalized arterials.

FIG. 1 is a block diagram of a system for estimating time travel distributions on signalized arterials. The system of FIG. 1 includes a client computer 110, network 120, and a server 130. Client computer 110 and server 130 may communicate with one another over network 120. Client computer 110 may be implemented as a desktop, laptop, work station, notebook, tablet computer, smart phones, mobile device or other computing device. Network 120 may be implemented as one or more of a private network, public network, WAN, LAN, an intranet, the Internet, a cellular network or a combination of these networks.

Client computer 110 may implement all or a portion of the functionality described herein, including receive traffic data and other data or and information from devices using re-identification technologies. Such technologies may be based on magnetic signatures, toll tags, license plates, or embedded devices, such as Bluetooth receivers. Notably, sampling sizes obtained from such technologies can be orders of magnitude greater than those obtained from mobile GPS units. Notwithstanding that fact, server 130 may also receive probe data from GPS-connected mobile devices. Server 130 may communicate data directly with such data collection devices. Server 130 may also communicate, such as by sending and receiving data, with a third-party server, such as the one maintained by Sensys Networks, Inc. of Berkeley, Calif. and accessible through the Internet at www.sensysresearch.com.

Server computer 130 may communicate with client computer 110 over network 120. Server computer may perform all or a portion of the functionality discussed herein, which may alternatively be distributed between client computer 110 and server 130, or may be provided by server 130 as a network service for client 110. Each of client 110 and server computer 130 are listed as a single block, but it is envisioned that either be implemented using one or more actual or logical machines.

In one embodiment, the system may utilize Bayesian Inference principles to update a prior belief based on new data. In such an embodiment, the system may determine the distribution of travel times y on a given signalized arterial at the present time T. The prior beliefs may include the shape of the travel time distribution and the range of its possible parameters $\theta_T$ (e.g., mean and standard deviation) that are typical of a given time of day, such that y follows a probability function $p(y|\theta_T)$. These parameters themselves may follow a probability distribution $p(\theta_T|\alpha_T T)$ called the prior distribution. The prior distribution may comprise its own set of parameters $\alpha_T$, which are referred to as hyper-parameters.

The system may estimate the current parameters using a recent (e.g., 20 minutes ago or less in some embodiments) travel time observation of the arterial of interest. The system may also account for observations on neighboring streets. In still further embodiments, the system may consider contextual evidence such as local weather, incidents, and special events such as sporting events, one off road closures, or other intermittent traffic diversions. In one embodiment, $y_i^*$ may designate the current travel time observations. The system may determine the likeliest $\theta_T$ using a known $y_i^*$ and $\alpha_T$.

The system 100 may account for one or more travel time variability components. First, there may be individual variations between vehicles traveling at the same time of day. These variations stem from diverse driving profiles among drivers and their varying luck with traffic signals. Second, there may be recurring time-of-day variations that stem from fluctuating traffic demand patterns and signal timing. Third, there may be daily variations in the distributions of travel times over a given time slot. System 100 may account for other time travel variability components.

In one exemplary embodiment, the system 100 may employ standard Traffic Message Channel (TMC) location codes as base units of space, and fifteen-minute periods as base units of time. In such an embodiment, the system 100 approximates that traffic conditions remain homogeneous across a given TMC location code over each fifteen-minute period. The system 100 may also use other spatial or temporal time units depending on the degree of precision desired. For example, the system 100 may use a slightly coarser scale for the base units of space (e.g., segments a few miles or kilometers long) to mitigate noise in the travel time data. Alternatively, the system 100 may use reidentification segments as the base units in the space domain. In such embodiments, the system 100 approximates that traffic conditions remain homogenous across a given reidentification segment over each fifteen-minute period. System 100 may also normalize travel time data into a unit of pace that is expressed in seconds per mile or seconds per kilometer. The system 100 may also calculate the average pace as a linear combination of individual paces weighted by distance traveled. Such calculations may be more convenient than using speed values.

System 100 may generate thousands of data plots of various types. For example, system 100 may generate boxed plots that represent the dispersion of travel times along a segment at various times of day. Those plots can be built either for a single day or by aggregating multiple days. System 100 may also generate travel time histograms that represent the distribution of travel times for a given slice of the data—typically a particular segment and time slot, either for a single day or multiple days taken in aggregate. The travel time histograms may be produced in at least series of three types: time-of-day singles, which show a single day's sequence in fifteen minute increments; time-of-day aggregates, which show time-of-day variations using an aggregate of multiple days; and daily time slot plots, which show the same time slot over multiple days. In various embodiments, other series types may likewise be generated and analyzed in accordance with the system and methods disclosed herein.

System 100 may also generate parameter plots, which represent the variations of key distribution parameters such as the min, max, $25^{th}$ $50^{th}$, or $75^{th}$ percentile or given interpercentiles as histograms. Parameter plots may be generated in at least three different ways: time-of-day parameter plots, which represent percentile variations during the day for each individual date; daily time slot parameter plots, which represent percentile variations across different days for every time slot; and density maps, which are two-dimensional plots of one percentile versus another for a given set of time slots and dates.

Figure 2:
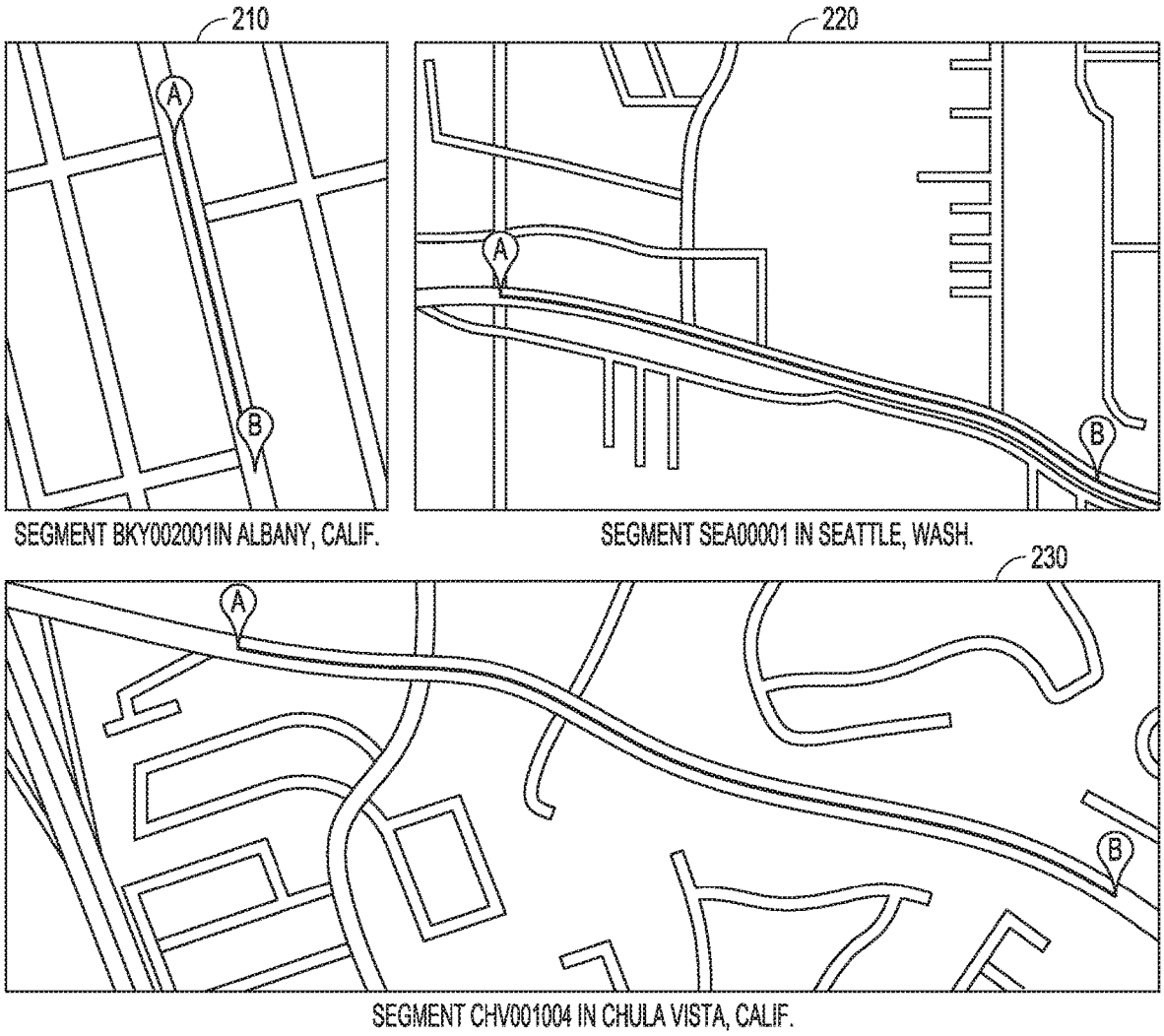
FIG. 2 is a series of maps 200 highlighting exemplary signalized arterial segments that may be analyzed using the technology disclosed herein.

FIG. 2 is a series of maps 200 highlighting exemplary signalized arterial segments that may be analyzed using the technology disclosed herein. Map 210 shows exemplary signalized arterial segment "BKY002001" located in Albany, Calif. Map 220 shows exemplary signalized arterial segment "SEA000001" located in Seattle, Wash. Map 230 shows exemplary signalized arterial segment "CHV001004" located in Chula Vista, Calif.

Figure 3:
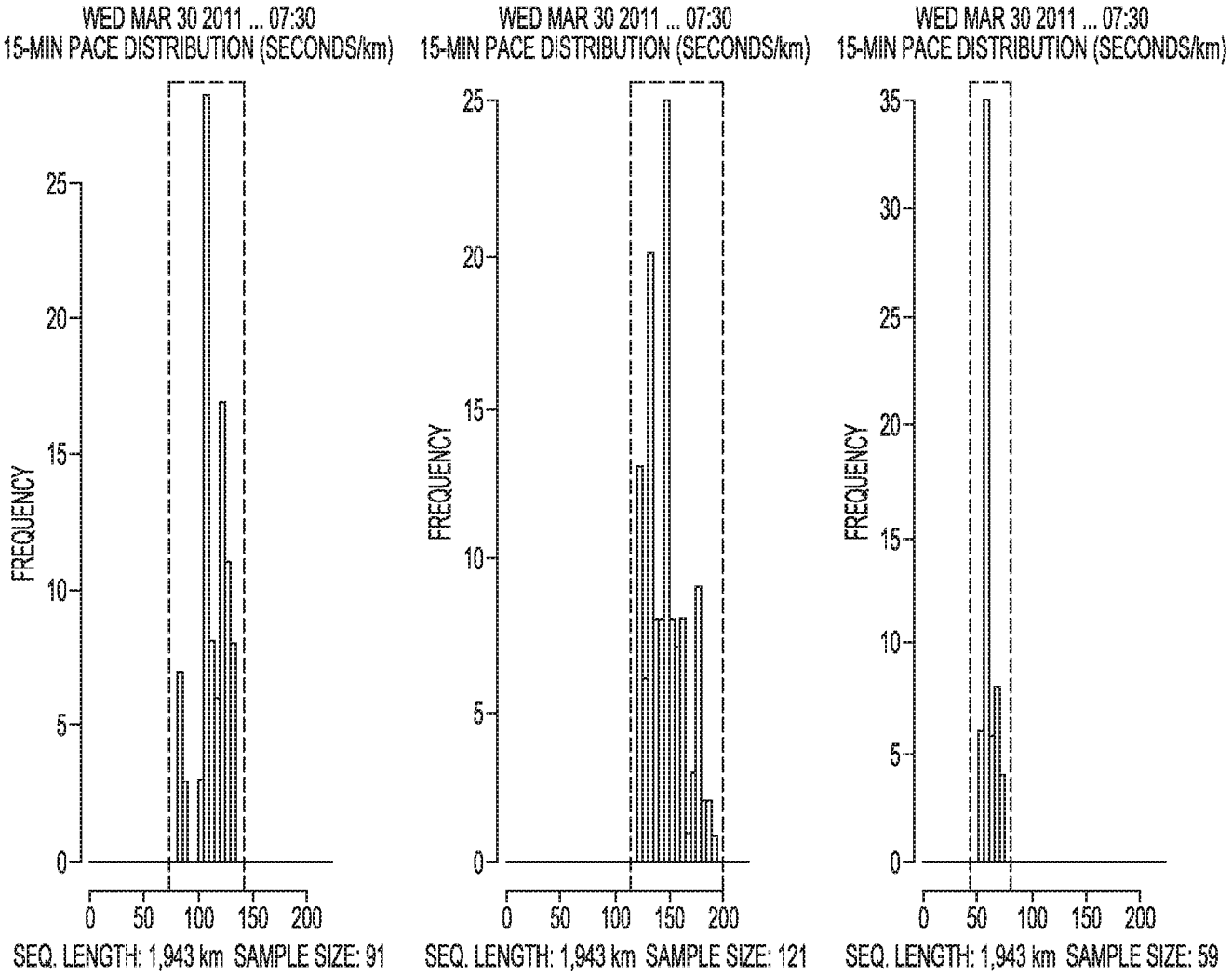
FIG. 3 is a series of graphs showing distributions of pace on a signalized arterial segment at the same time on over three consecutive days.

FIG. 3 is a series of graphs showing distributions of pace on a signalized arterial segment at the same time on over three consecutive days. More specifically, FIG. 3 shows an exemplary distribution of pace on a 2-km arterial segment in Seattle, Wash. for the same fifteen-minute time period on three consecutive days. As suggested in FIG. 3, determining an exact distribution shape for a given fifteen minute period on any given day may pose a difficult objective. The presently described system can, however, directly observe three different states of an arterial segment and then calibrate the prior probabilities of being in either state from archived data. The system may also use real-time data to help refine a given belief regarding which of the multiple states applies to the real-time prediction.

Figure 4:
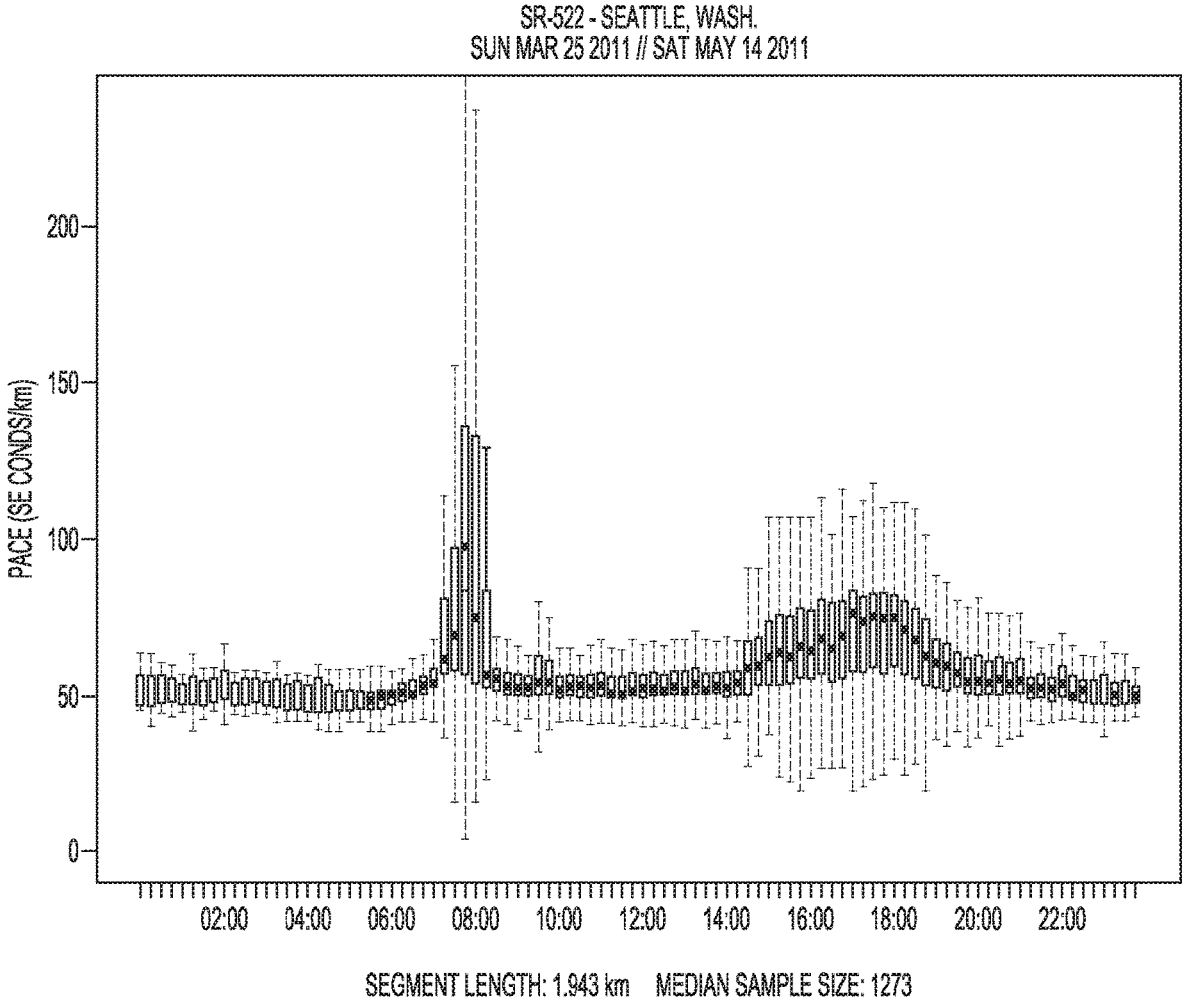
FIG. 4 is a graph showing variations in pace throughout different times periods time periods in a day.

FIG. 4 is a graph showing variations in pace throughout different times periods in a day. As shown in FIG. 4, the presently disclosed system may account for time-of-day variations. Notably, the box indicates the $25^{th}$, $50^{th}$, and $75^{th}$ percentile value while the dotted lines extend to extreme values. In such embodiments, the system may use data regarding regular patterns of increase and decrease in travel times to calibrate prior distributions by time of day.

Figure 5:
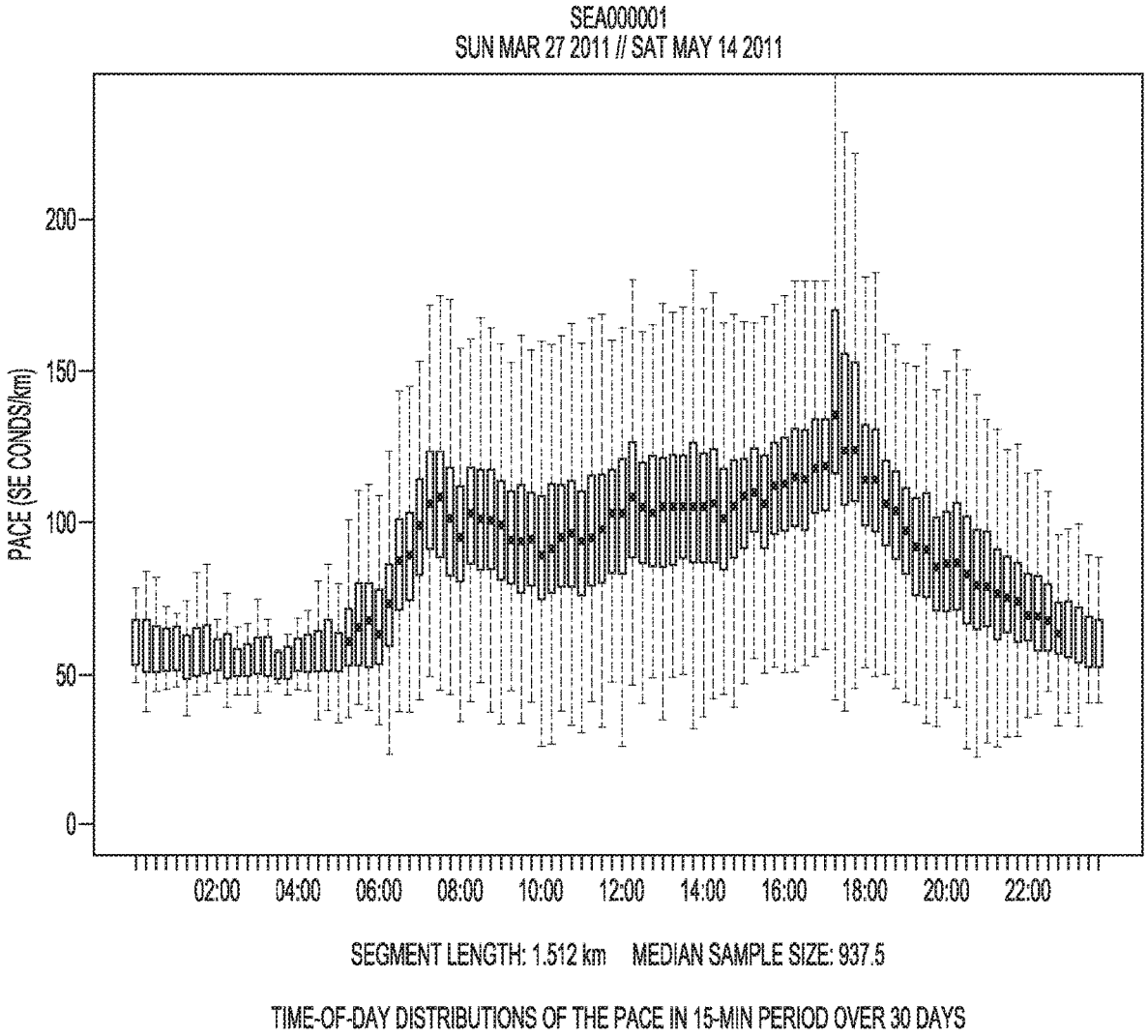
FIG. 5 is another graph showing variations in pace throughout different time periods in a day.

FIG. 5 is another time-of-day distribution graph showing variations in pace throughout different time periods in a day. More specifically, FIG. 5 shows a boxed plot of travel time dispersion by time of day across approximately 30 days in fifteen minute intervals. As in FIG. 4, the boxes indicate the $25^{th}$, $50^{th}$ (black dot), and $75^{th}$ percentiles, while the dotted lines or "whiskers" extend to the minimum and maximum.

Figure 6:
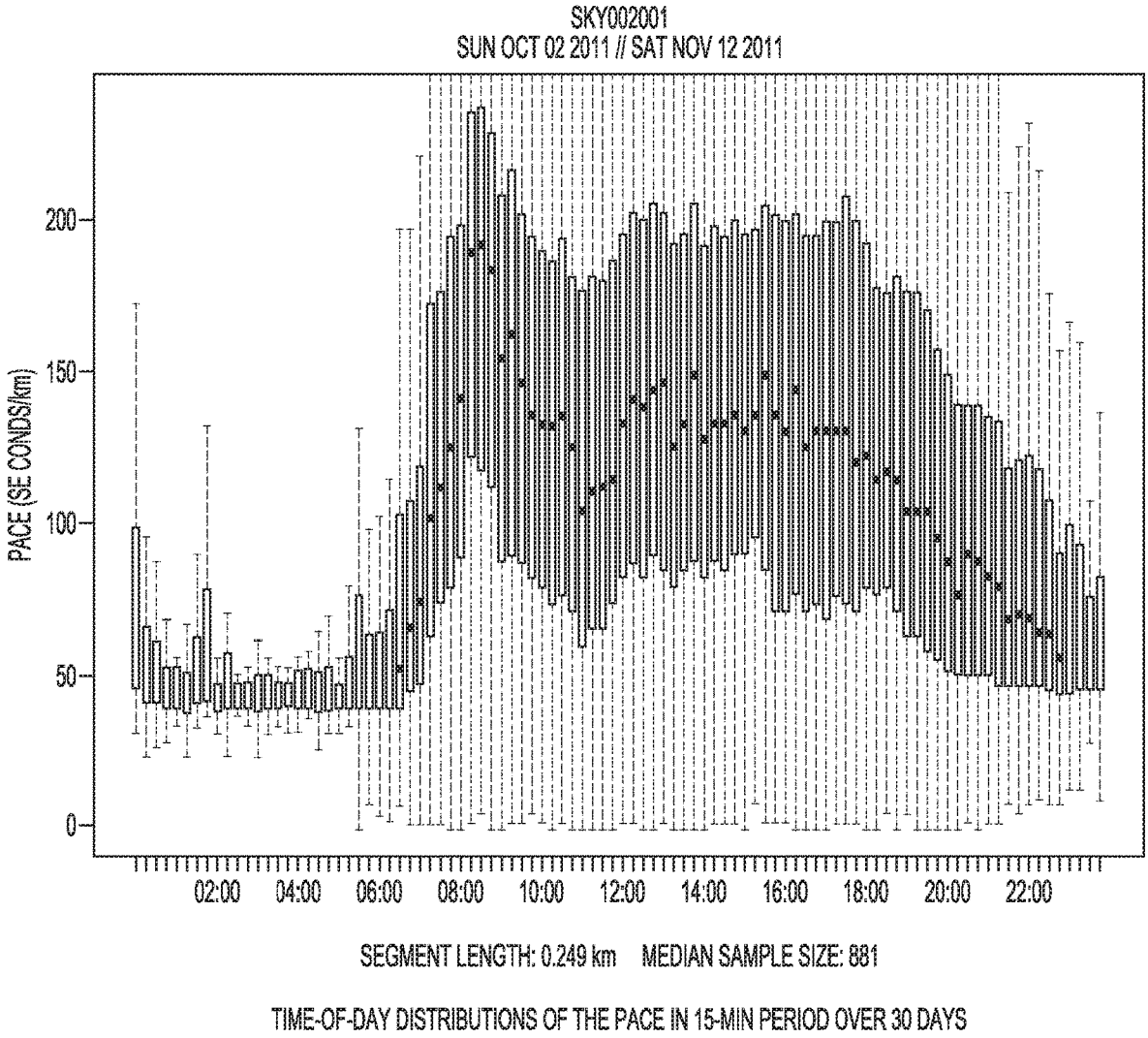
FIG. 6 is another graph showing variations in pace throughout different time periods in a day.

FIG. 6 is yet another graph showing variations in pace throughout different time periods in a day. FIG. 6 represents an exemplary data set from a different arterial segment than that illustrated in FIGS. 4 and 5. Namely, FIGS. 4 and 5 illustrate an exemplary data set from segment SEA000001 in Seattle, Wash., while FIG. 6 illustrates an exemplary data set from segment BKY002001 in Albany, Calif. As in FIGS. 4 and 5, the boxes indicate the $25^{th}$, $50^{th}$ (black dot), and $75^{th}$ percentiles, while the dotted lines or "whiskers" extend to the minimum and maximum.

Figure 7:
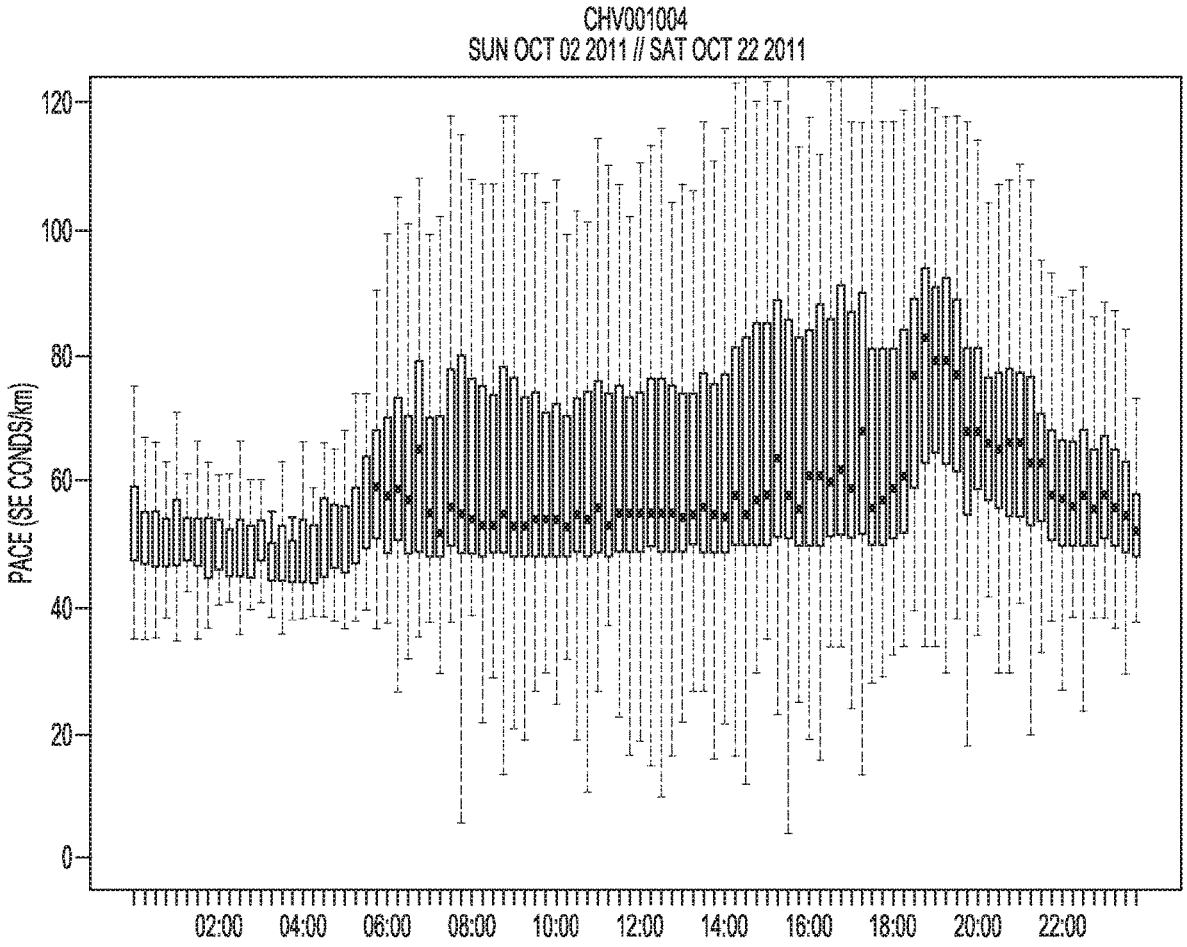
FIG. 7 is another graph showing variations in pace throughout different time periods in a day.

FIG. 7 is another graph showing variations in pace throughout different time periods in a day. FIG. 7 represents an exemplary data set from a different arterial segment than those illustrated in FIGS. 4, 5, and 6. Namely, FIG. 7 illustrates an exemplary data set from segment CHV001004 in Chula Vista, Calif. As in FIGS. 4-6, the boxes indicate the $25^{th}$, $50^{th}$ (black dot), and $75^{th}$ percentiles, while the dotted lines or "whiskers" extend to the minimum and maximum.

Figure 8A:
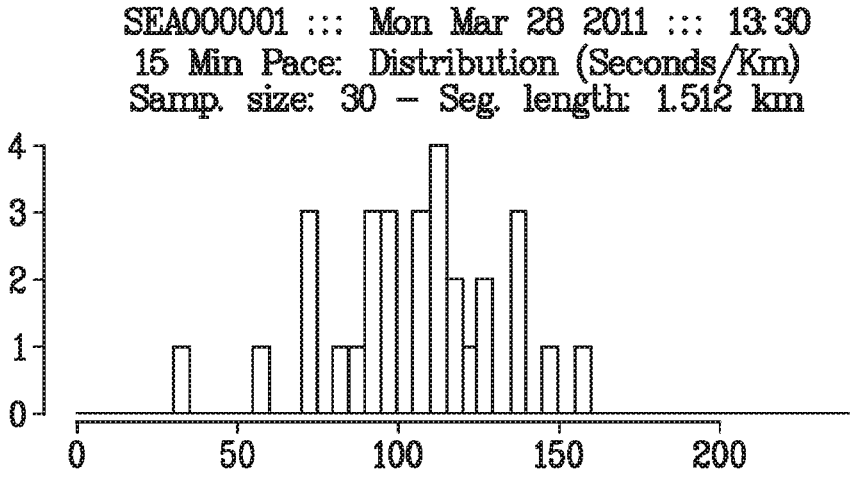
FIGS. 8A-X are series of histograms showing the diversity of possible distribution shapes generated by the system and methods disclosed herein.
Figure 8B:
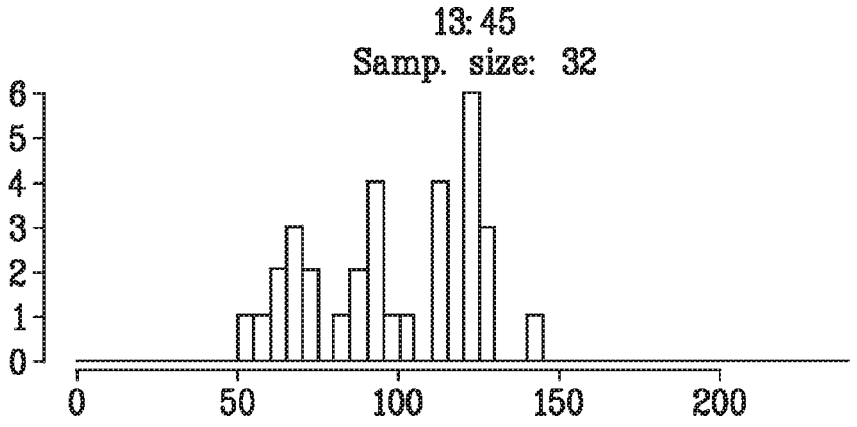
Figure 8C:
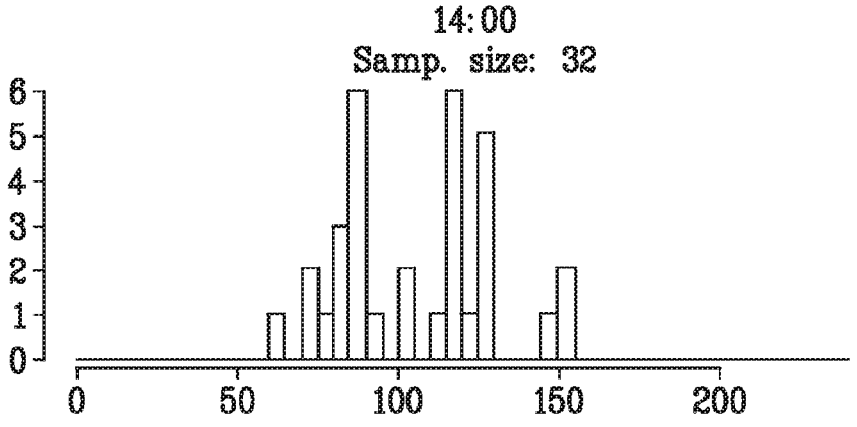
Figure 8D:
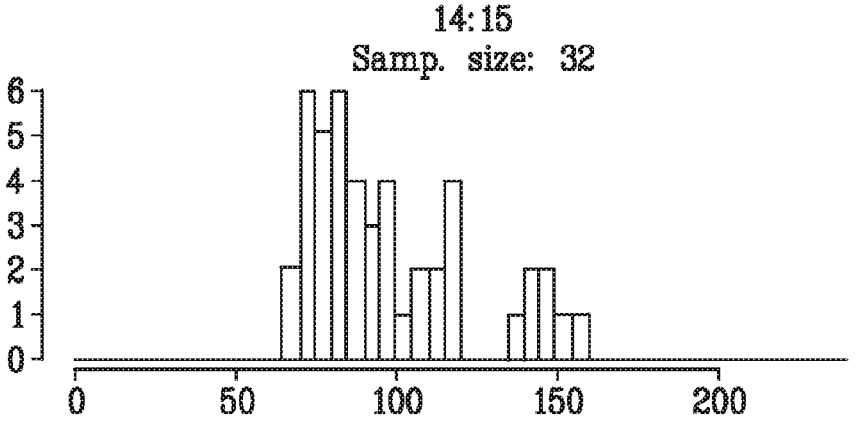
Figure 8E:
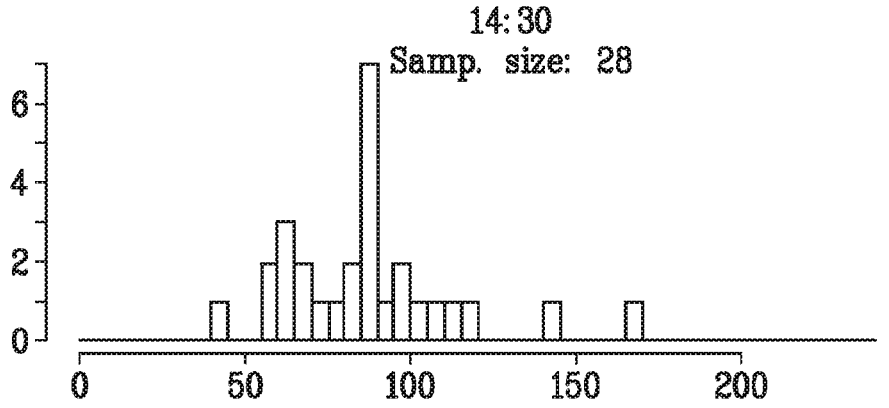
Figure 8F:
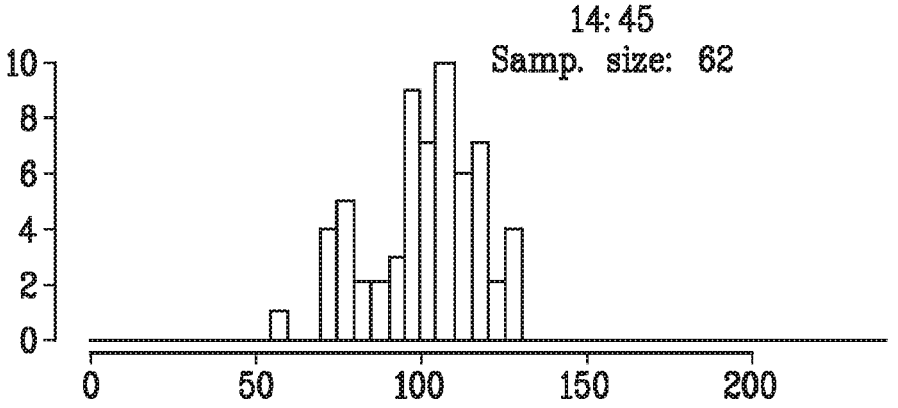
Figure 8G:
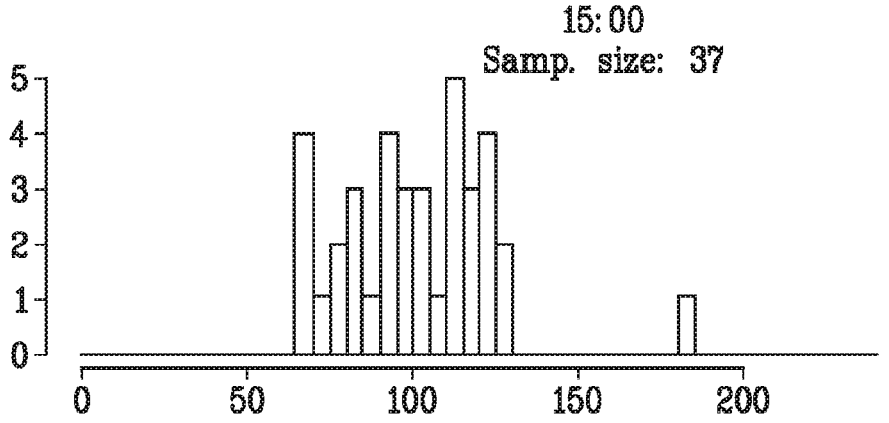
Figure 8H:
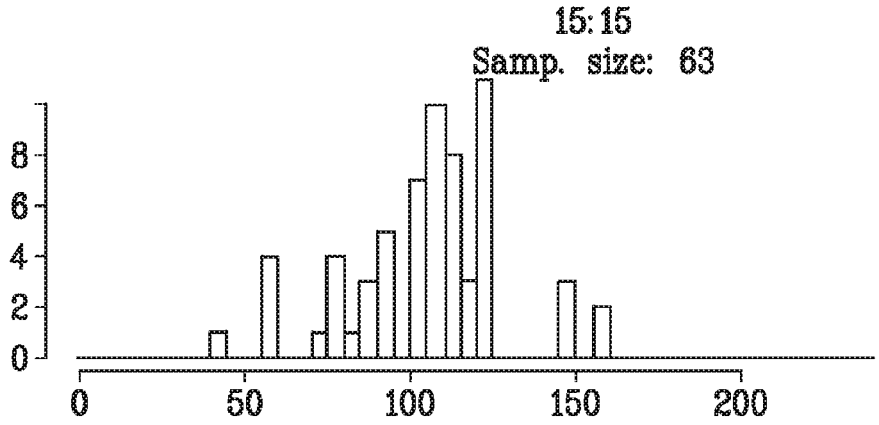
Figure 8I:
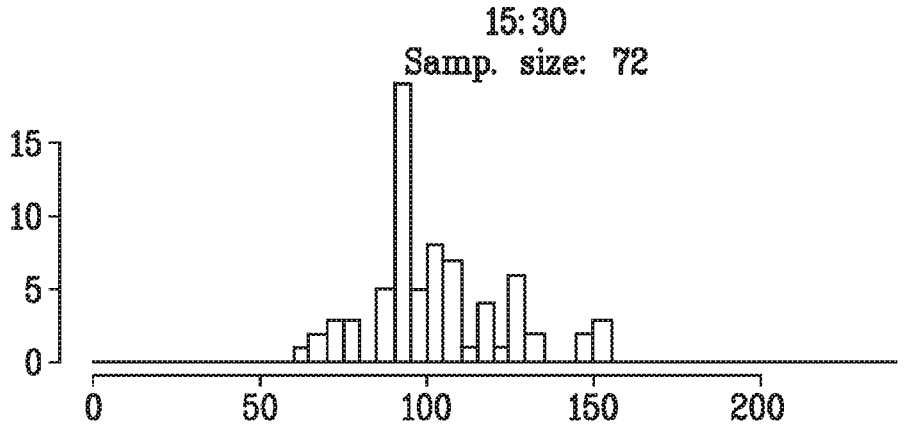
Figure 8J:
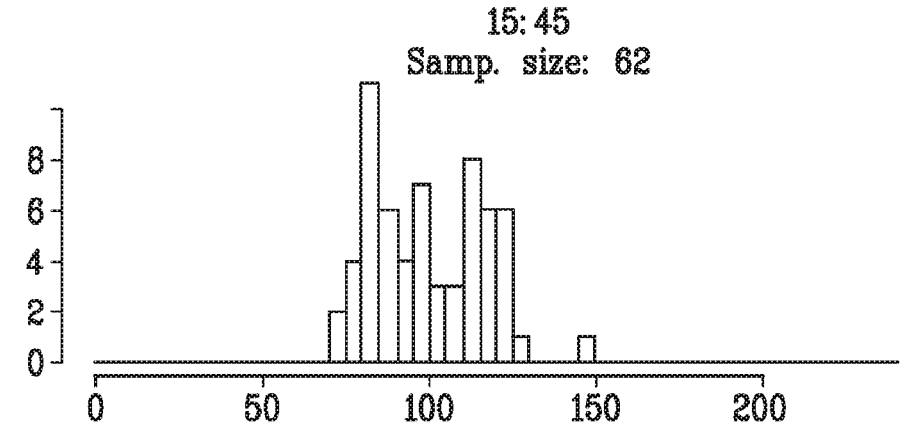
Figure 8K:
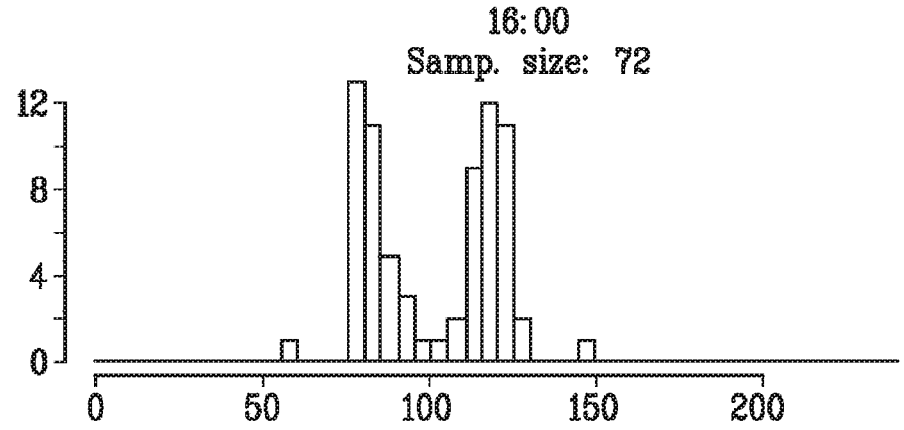
Figure 8L:
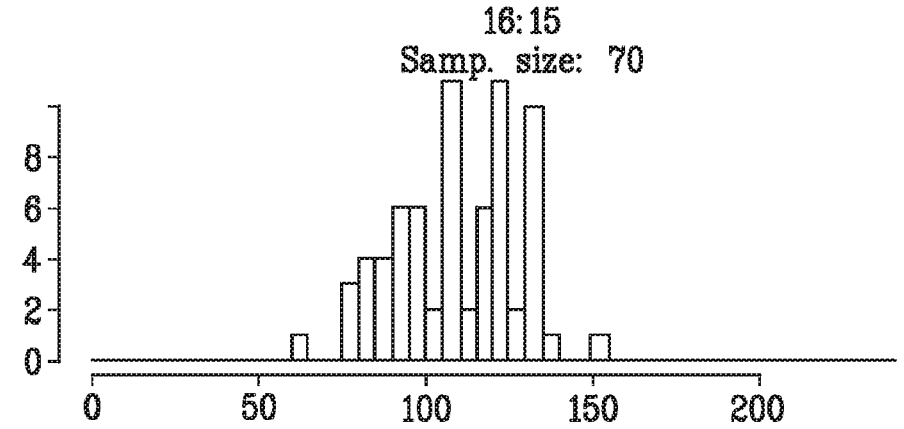
Figure 8M:
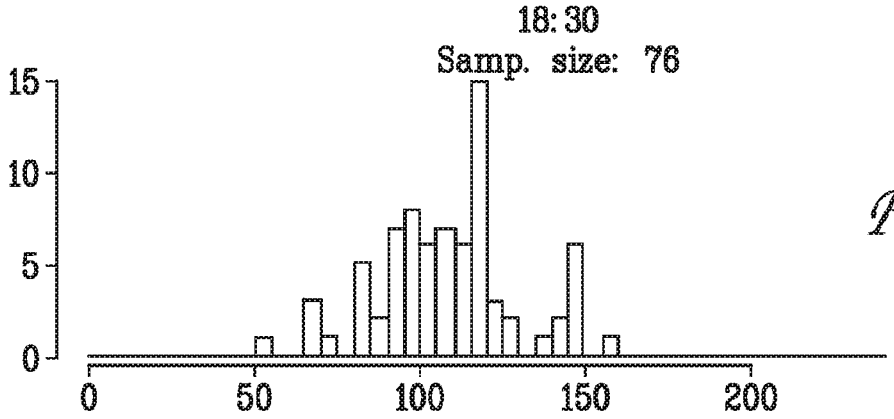
Figure 8N:
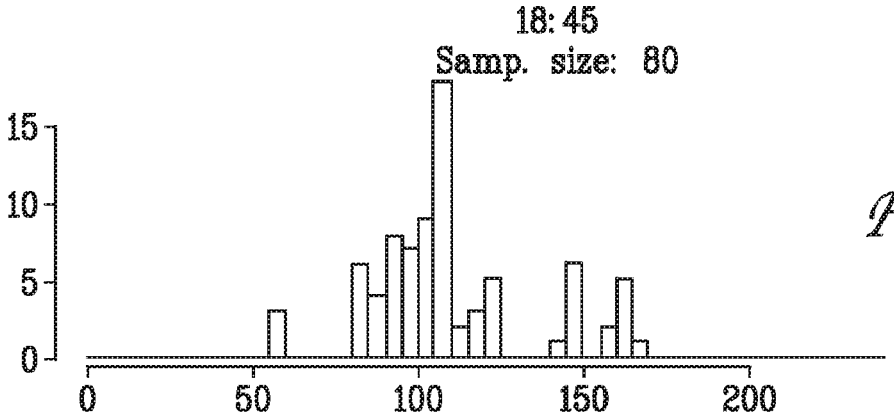
Figure 8O:
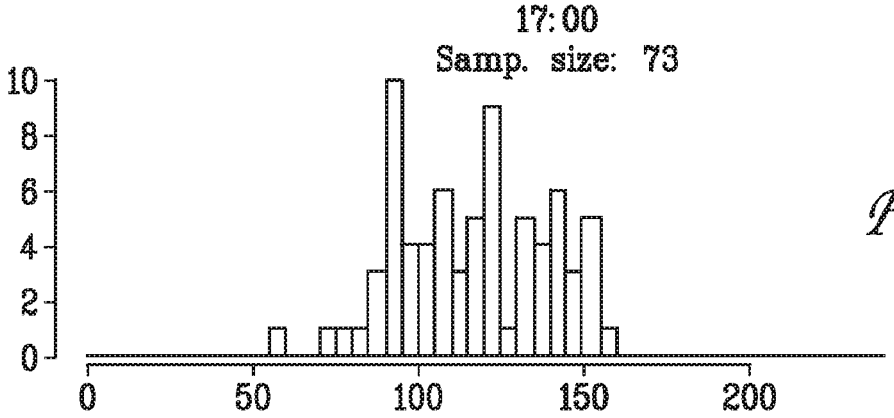
Figure 8P:
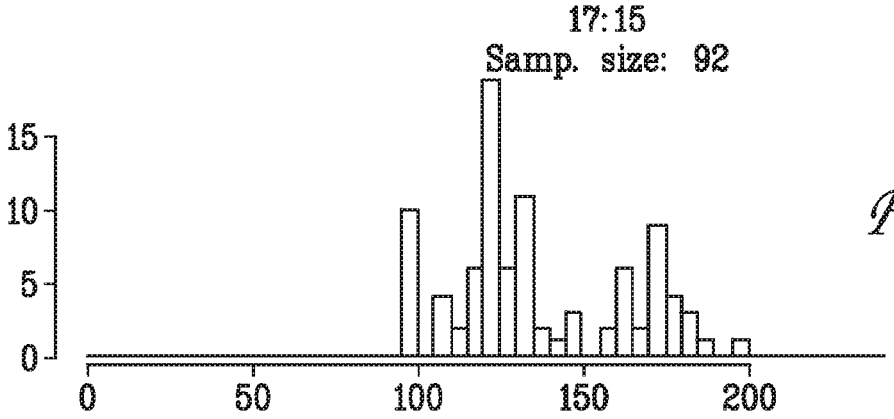
Figure 8Q:
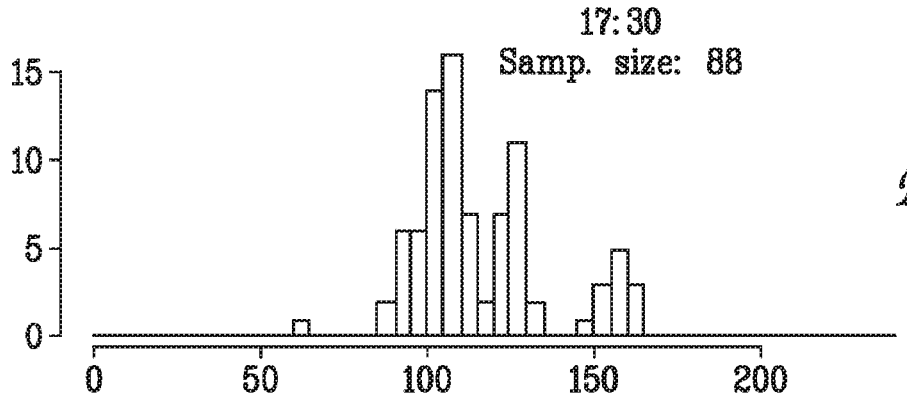
Figure 8R:
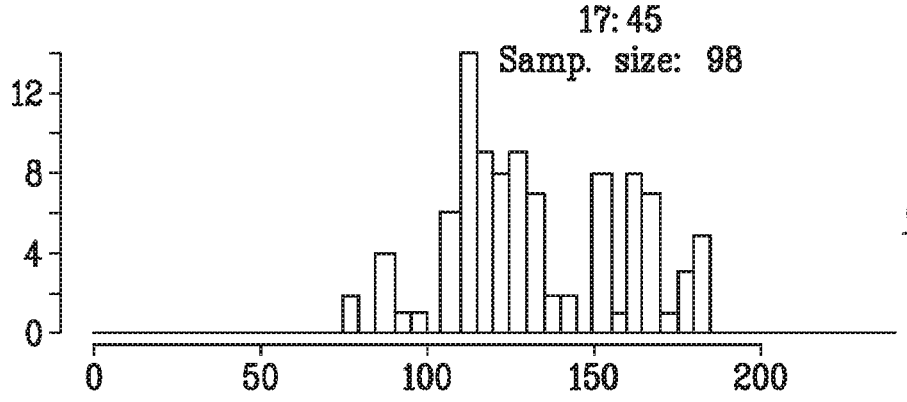
Figure 8S:
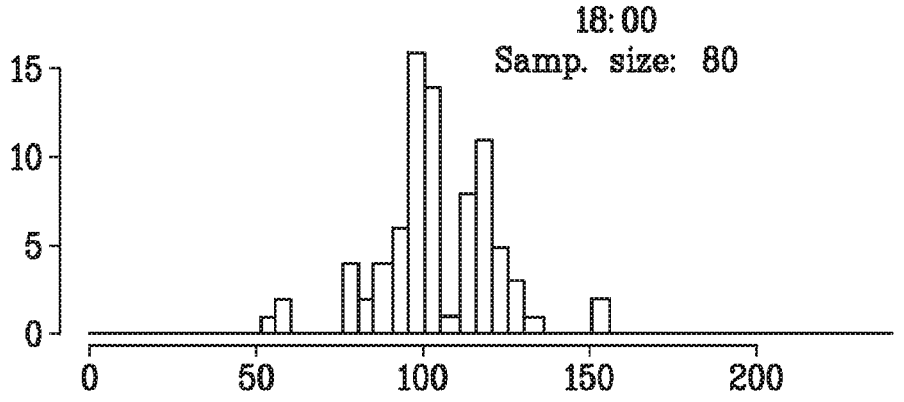
Figure 8T:
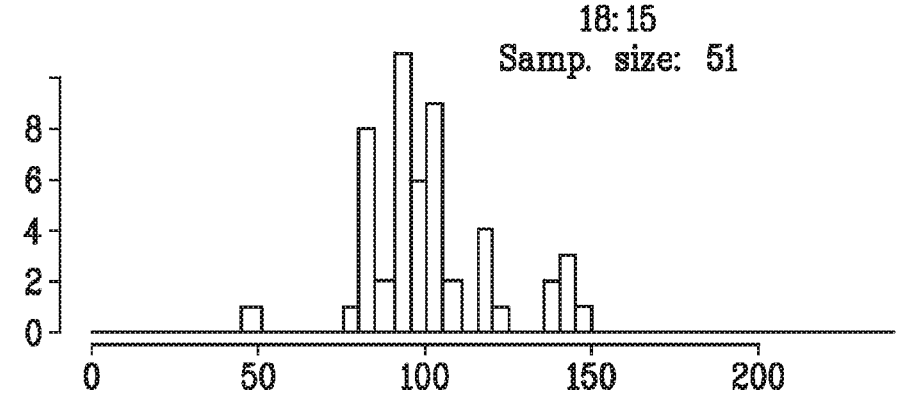
Figure 8U:
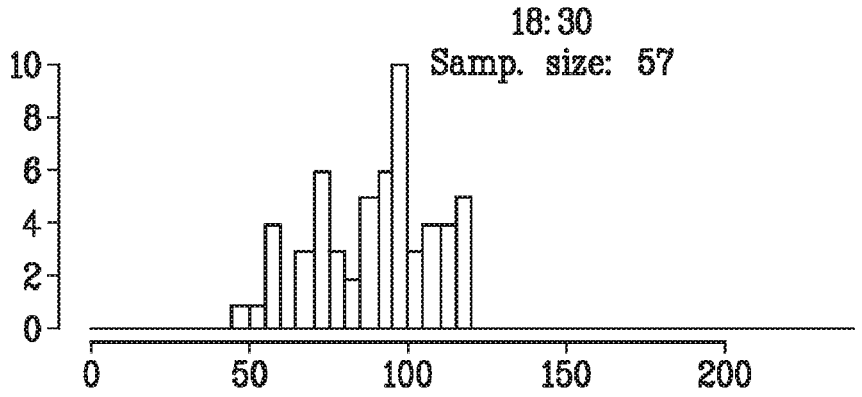
Figure 8V:
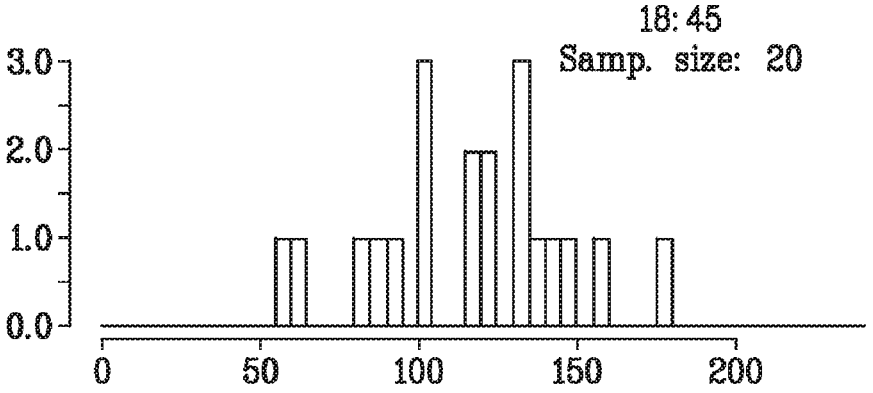
Figure 8W:
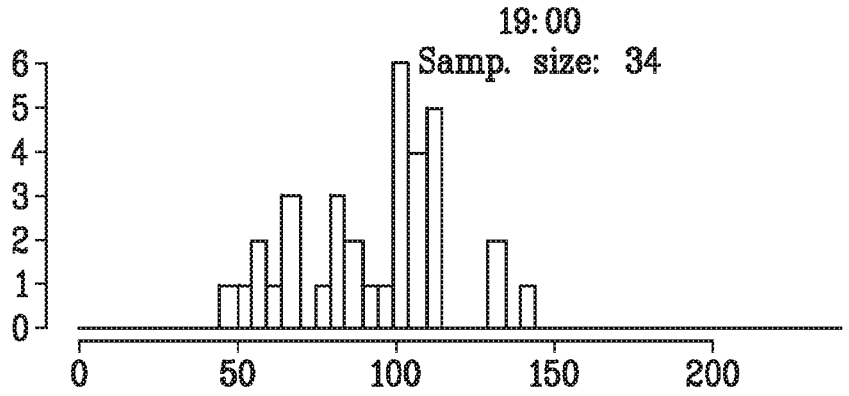
Figure 8X:
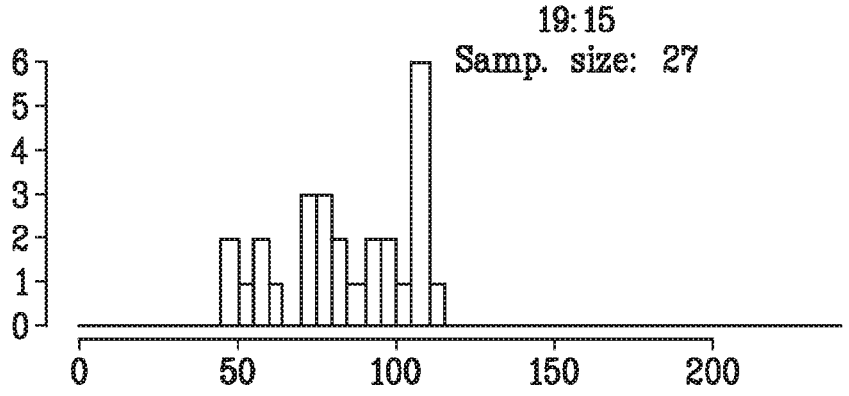

FIGS. 8A-X are a series of histograms showing the diversity of possible distribution shapes generated by the system and methods disclosed herein. Specifically, FIGS. 8A-X display histograms for sequential fifteen-minute periods on a particular day between 1:30 PM and 4:30 PM, where the time periods are shown in 24-hour notation in FIGS. 8A-X. The histograms shown in FIGS. 8A-X reveal a variety of distribution forms. System 100 may generate one or more of those forms depending on the system configuration and the data collection goal. Those forms may include relatively uniform distribution forms, forms featuring a sharp peak, or forms clearly exhibiting multiple modes.

Figure 9A:
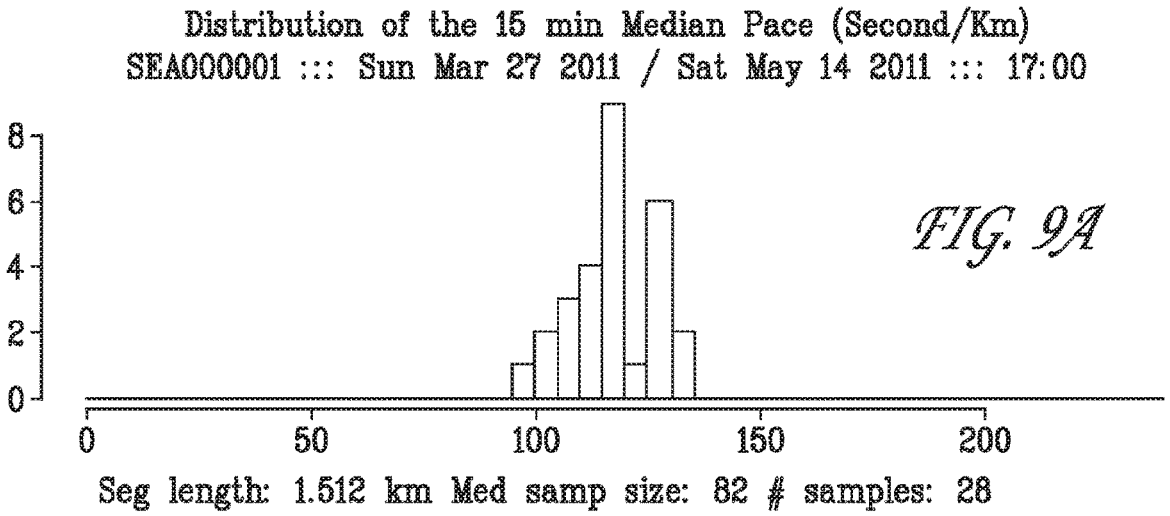
FIGS. 9A-F are another series of graphs showing the distribution of certain parameters for two consecutive time slots from approximately 30 days of data.
Figure 9B:
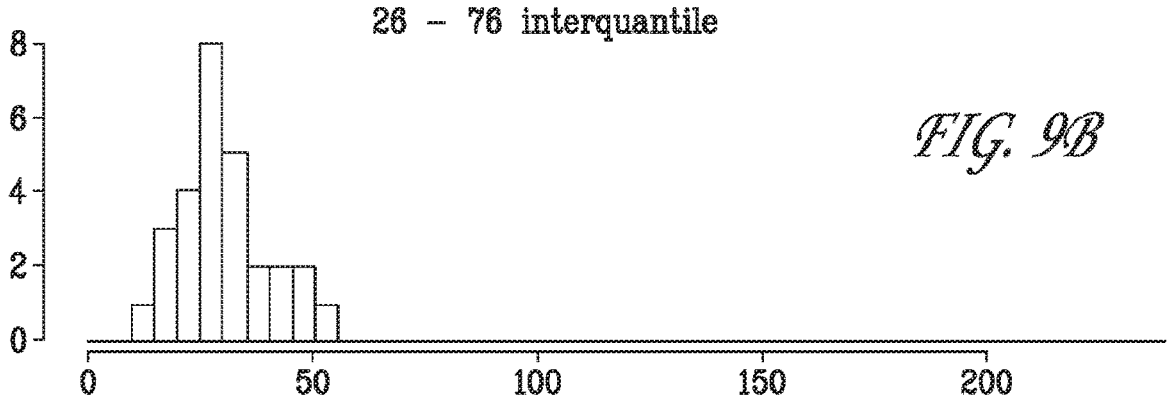
Figure 9C:
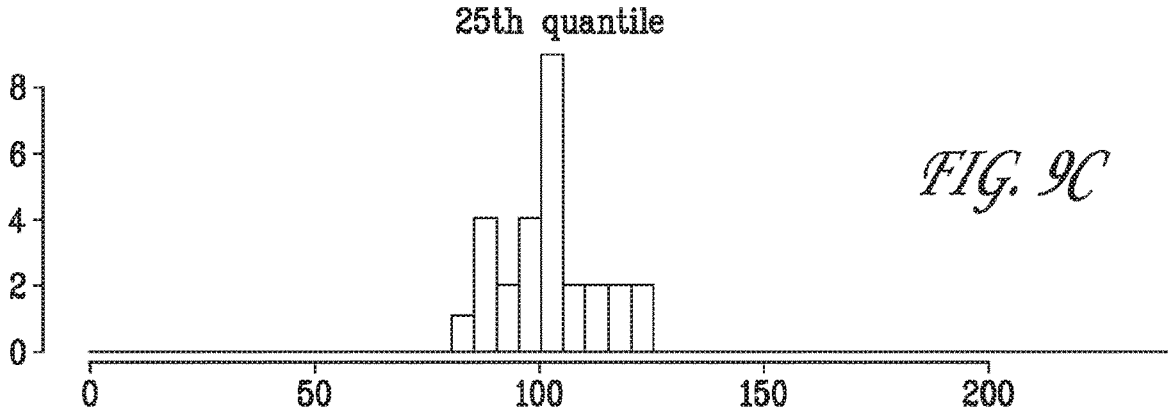
Figure 9D:
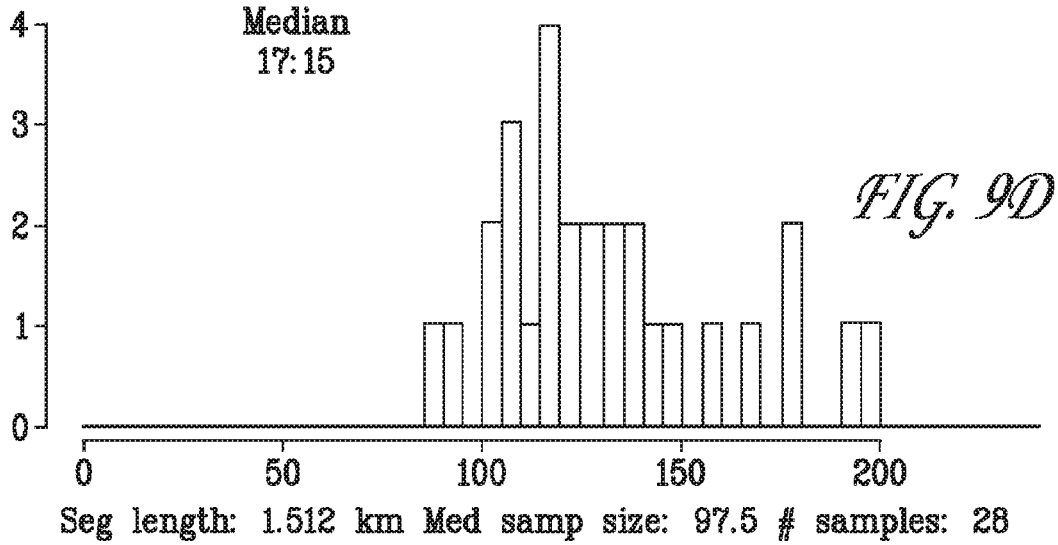
Figure 9E:
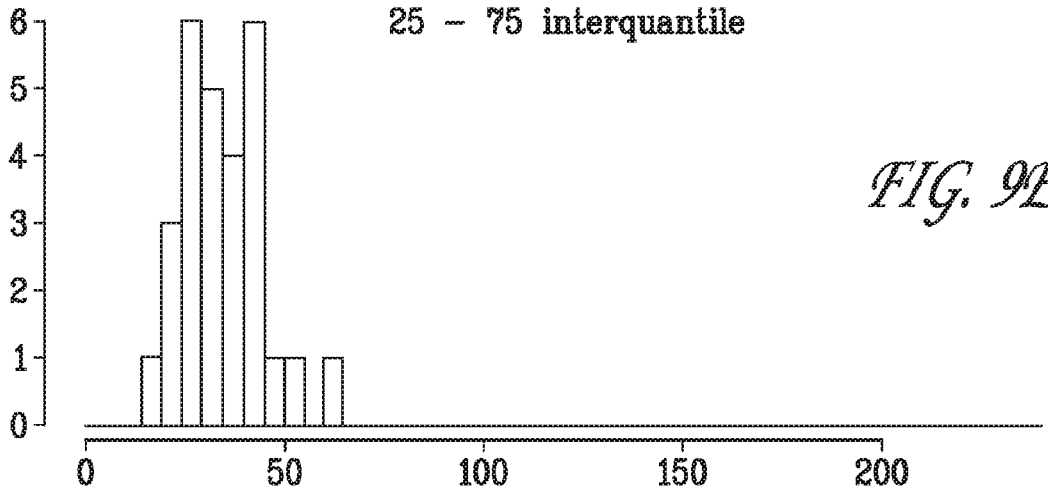
Figure 9F:
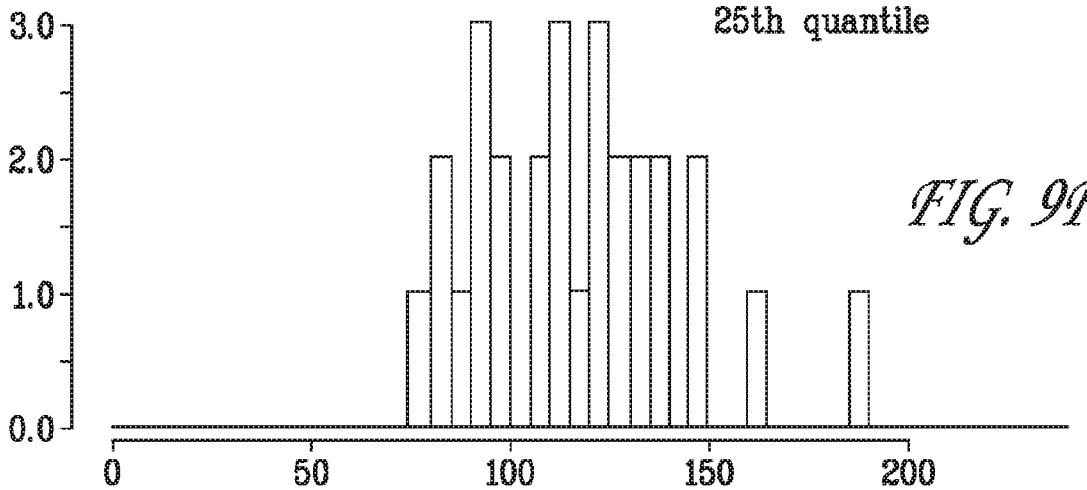
Figure 10A:
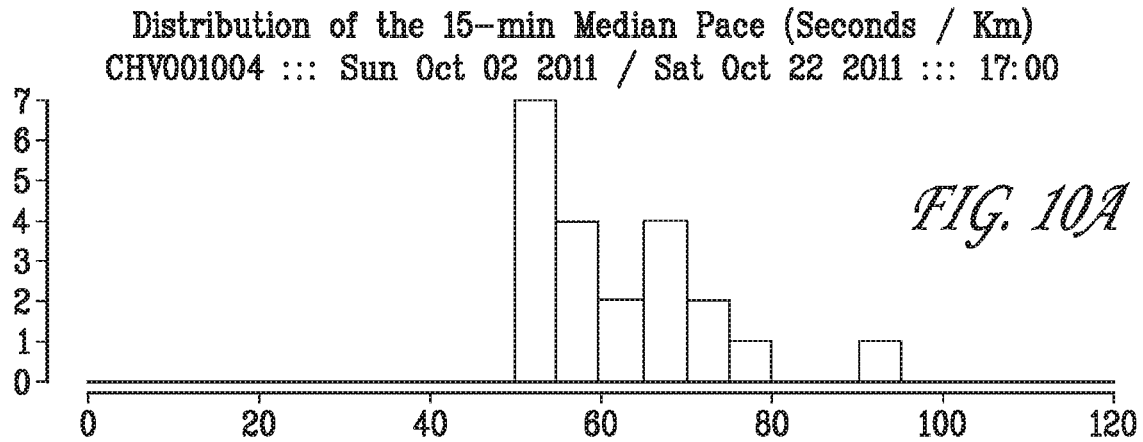
FIGS. 10A-P are a series of graphs showing an exemplary quantile distribution.
Figure 10B:
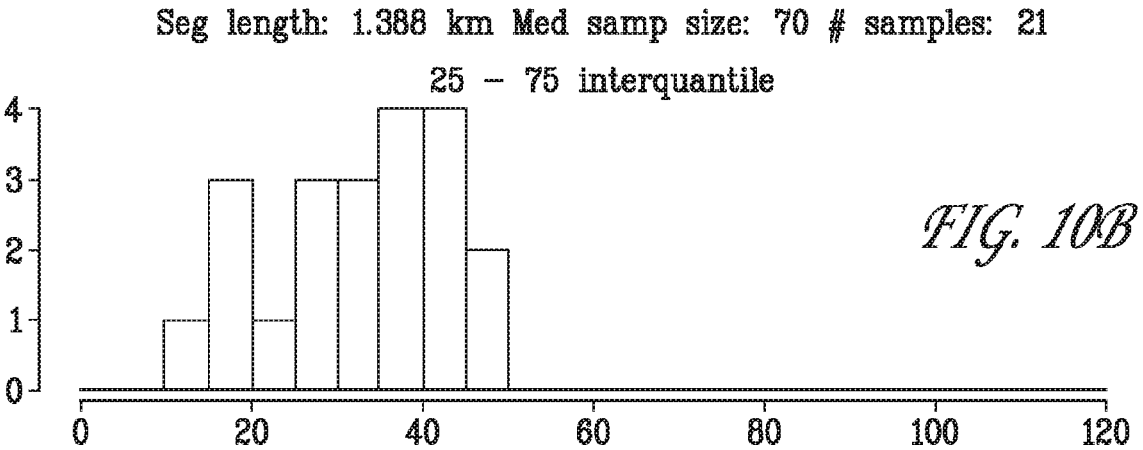
Figure 10C:
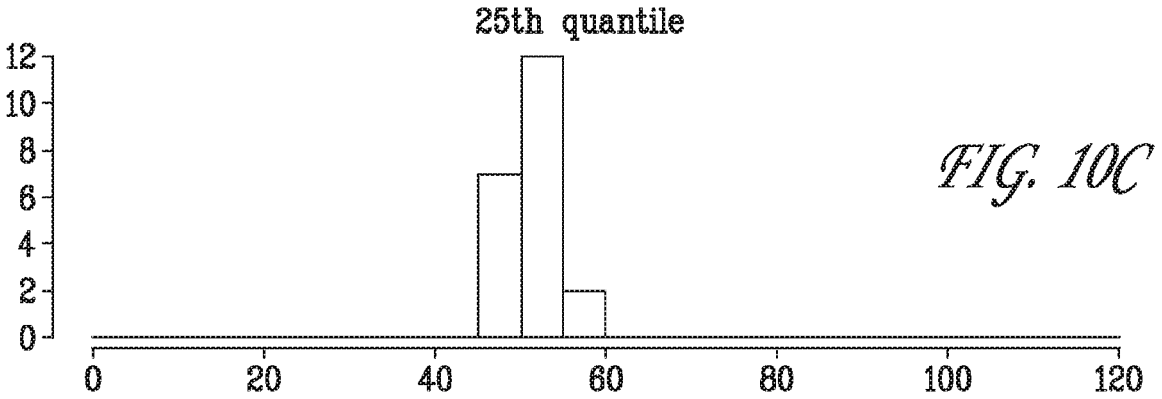
Figure 10D:
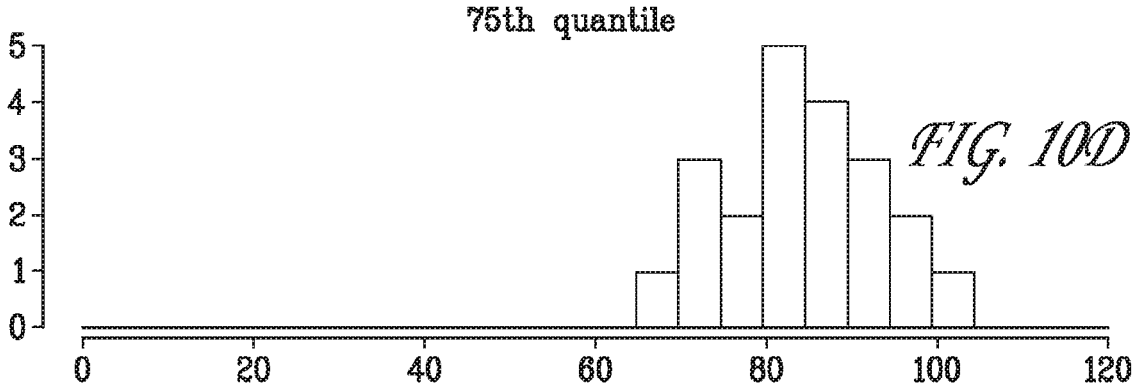
Figure 10E:
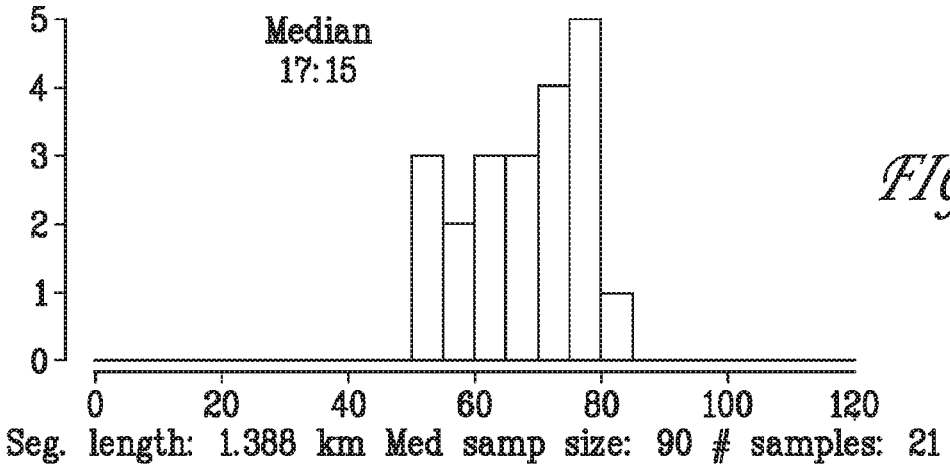
Figure 10F:
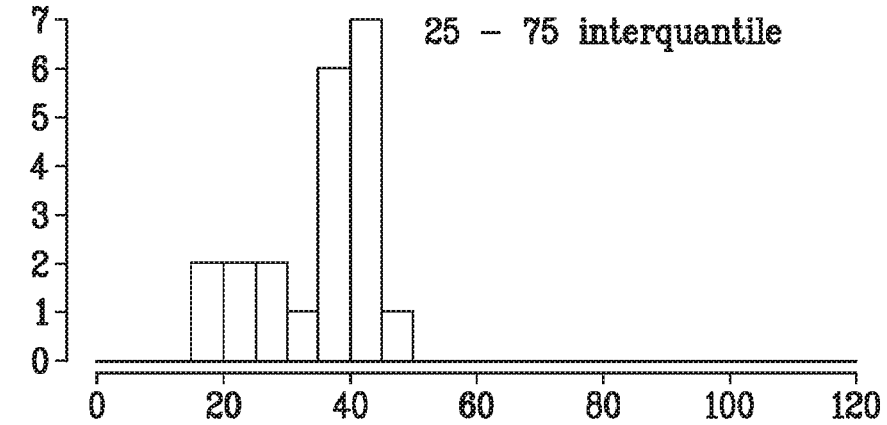
Figure 10G:
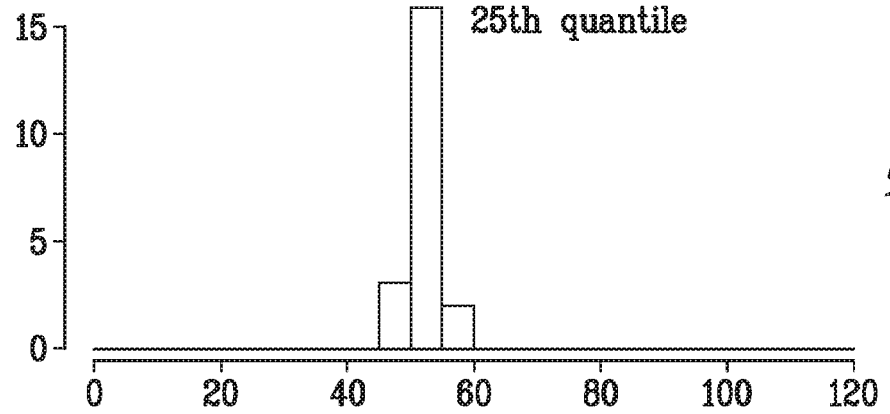
Figure 10H:
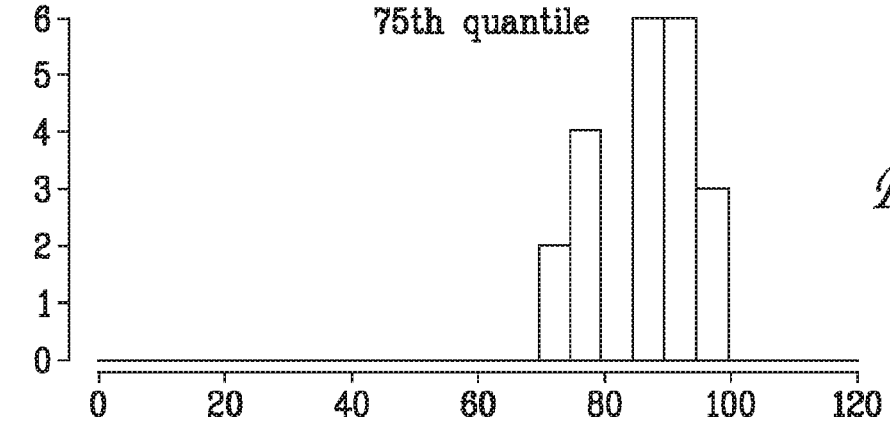
Figure 10I:
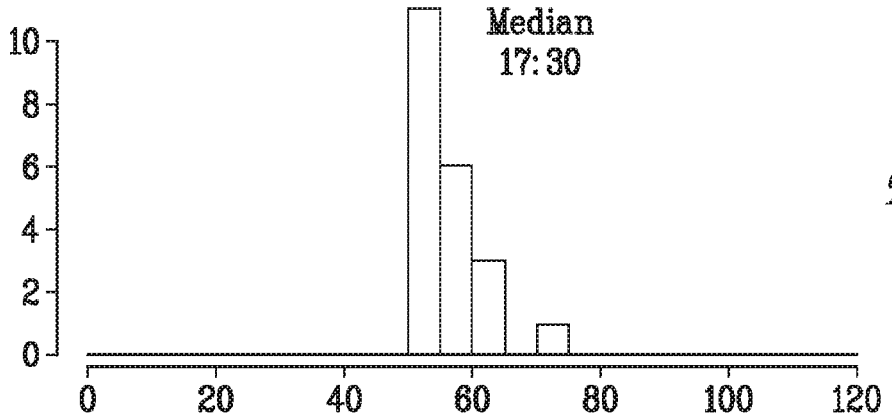
Figure 10J:
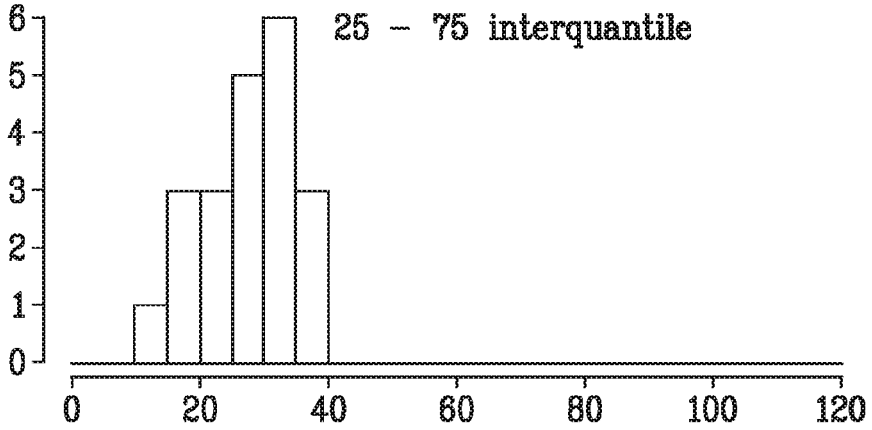
Figure 10K:
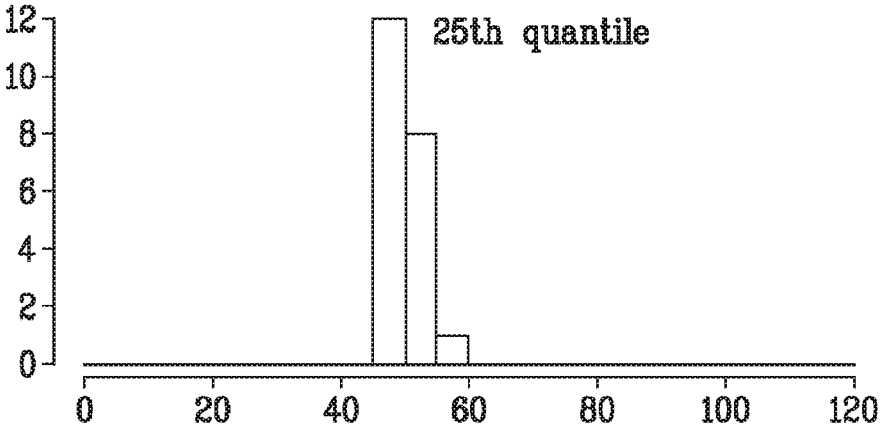
Figure 10L:
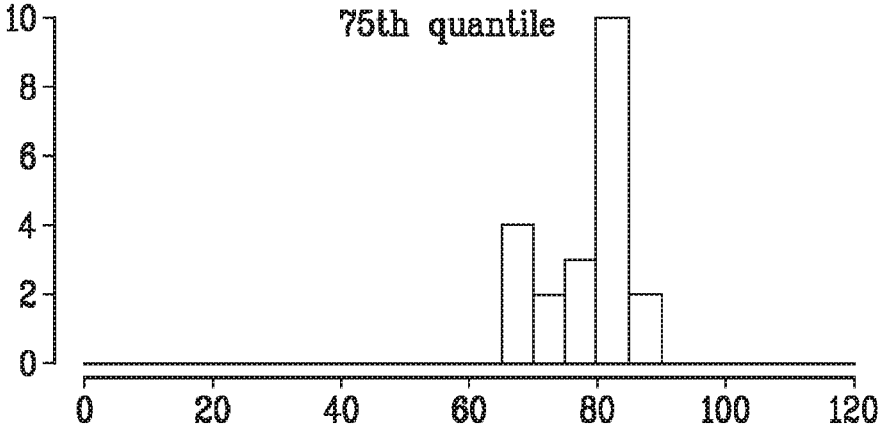
Figure 10M:
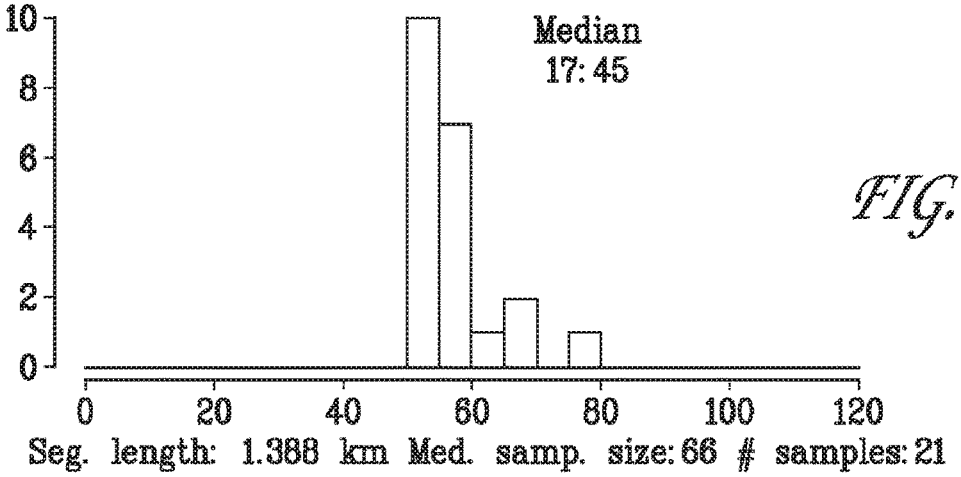
Figure 10N:
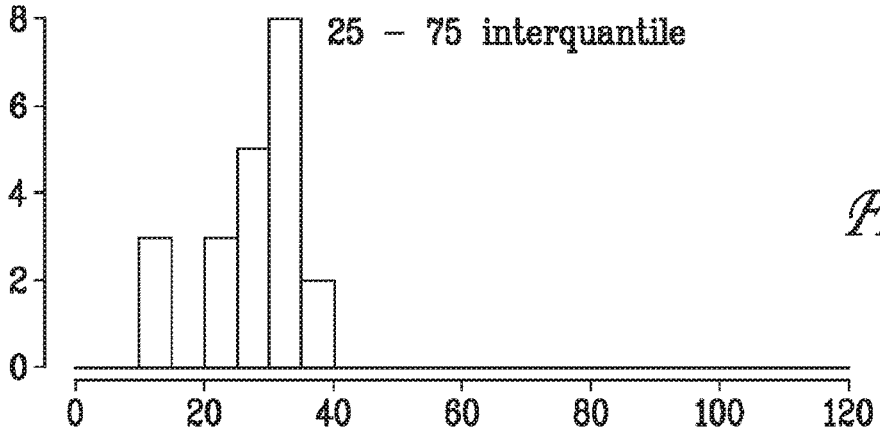
Figure 10O:
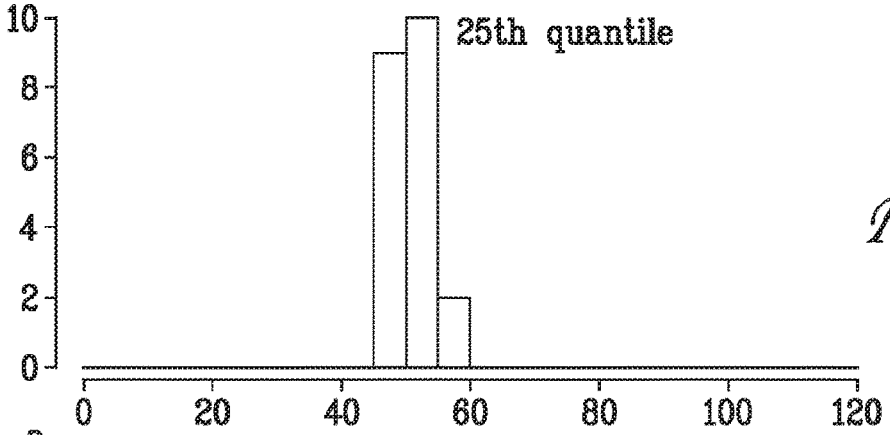
Figure 10P:
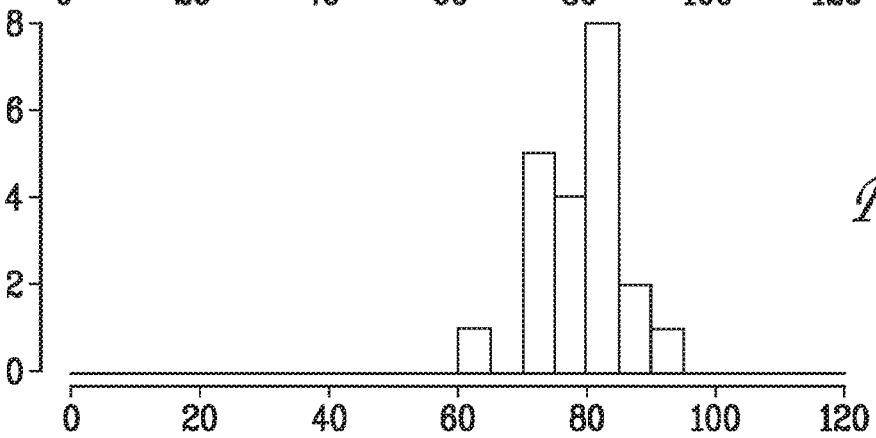
Figure 11A:
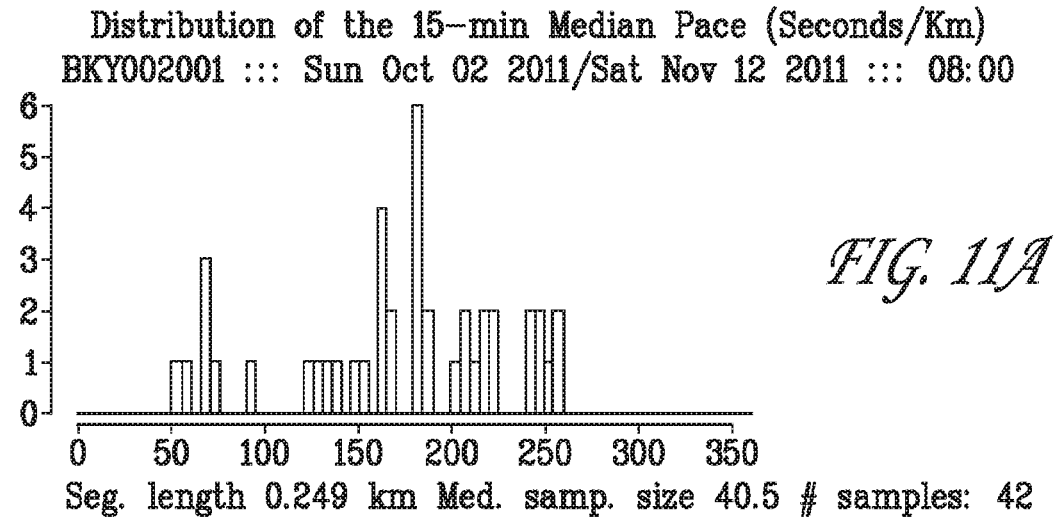
FIGS. 11A-P are yet another series of graphs showing an exemplary quantile distribution.
Figure 11B:
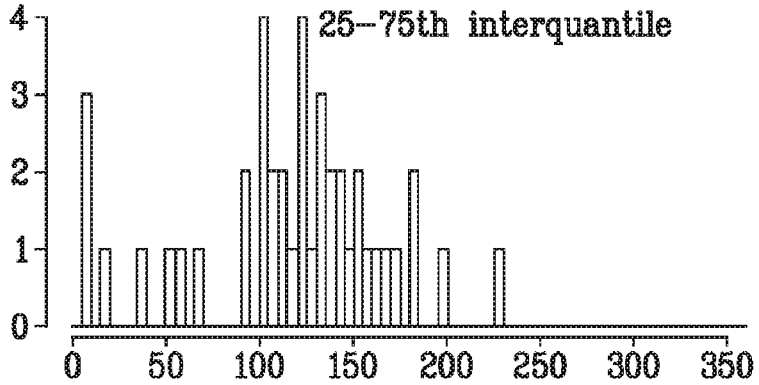
Figure 11C:
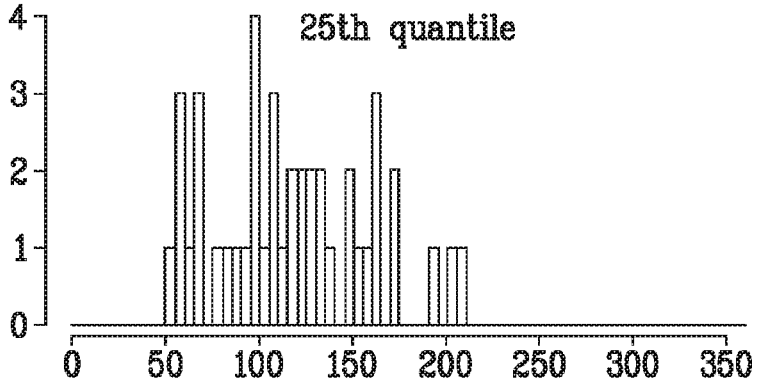
Figure 11D:
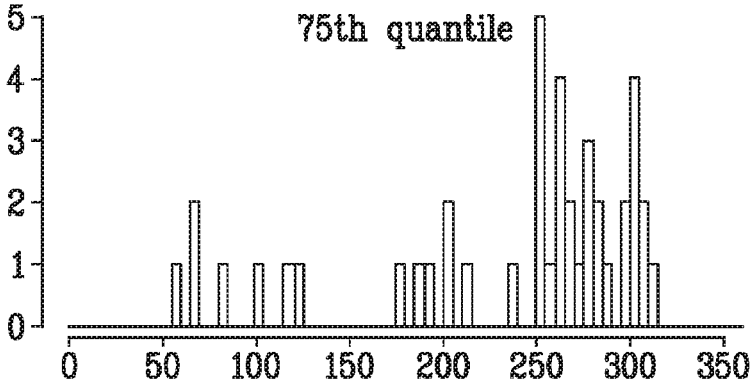
Figure 11E:
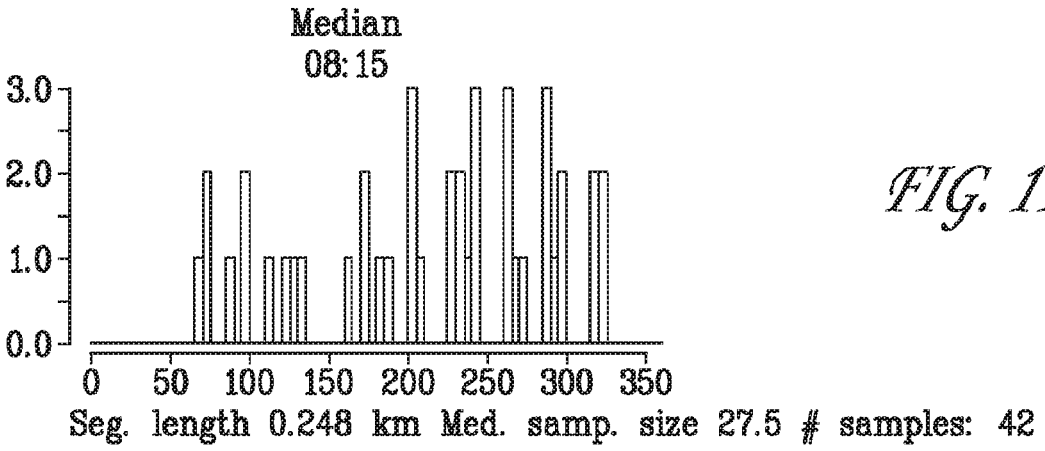
Figure 11F:
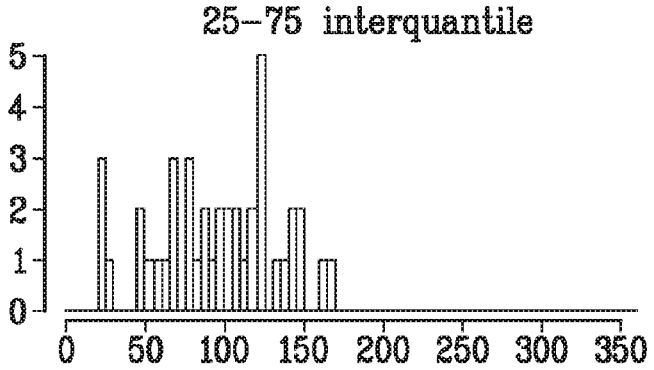
Figure 11G:
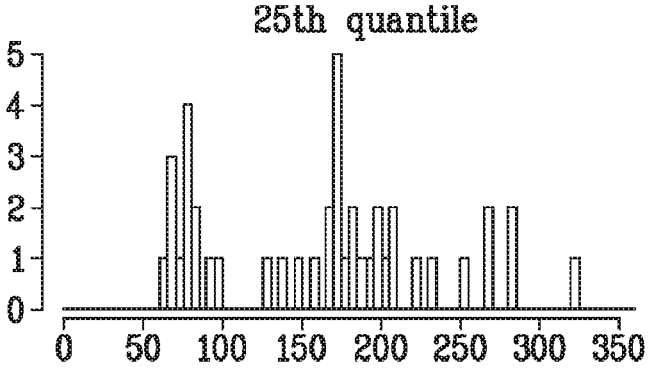
Figure 11H:
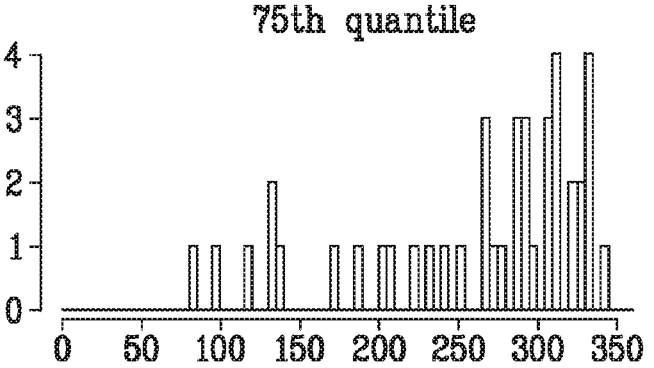
Figure 11I:
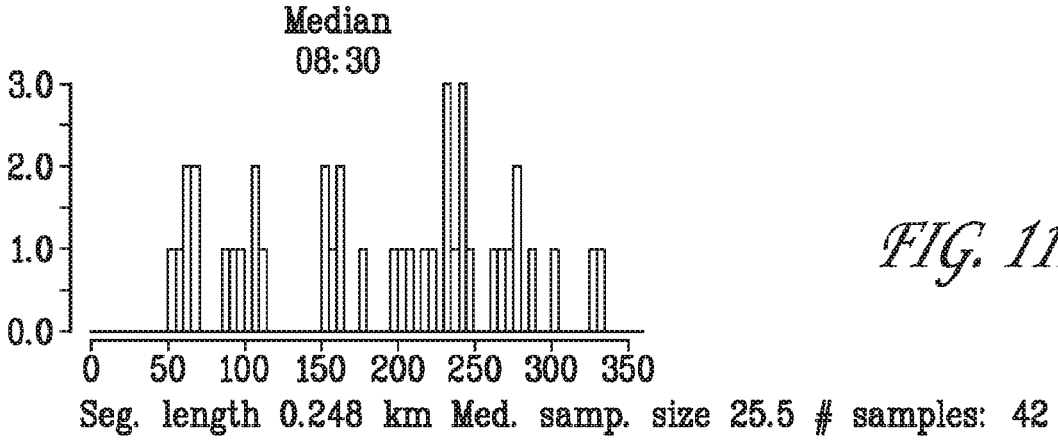
Figure 11J:
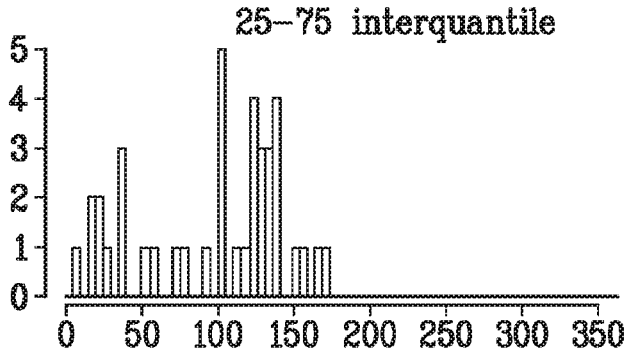
Figure 11K:
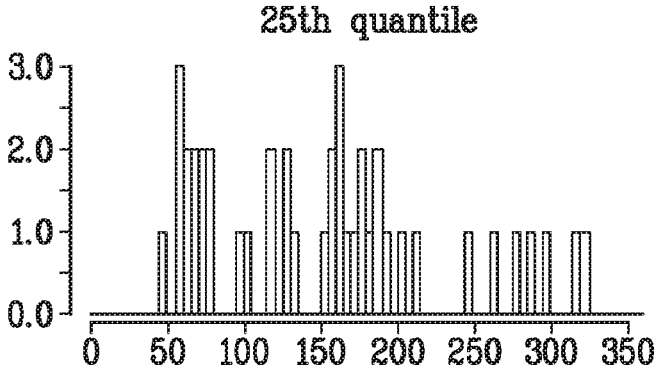
Figure 11L:
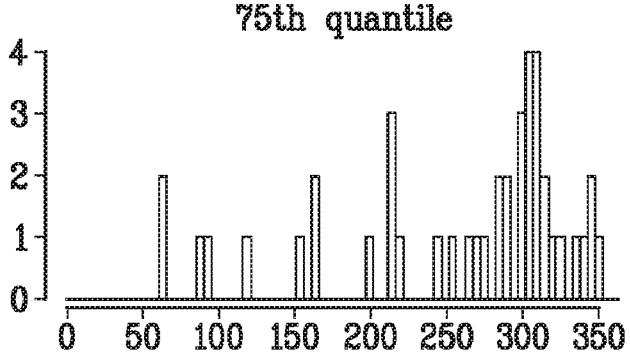
Figure 11M:
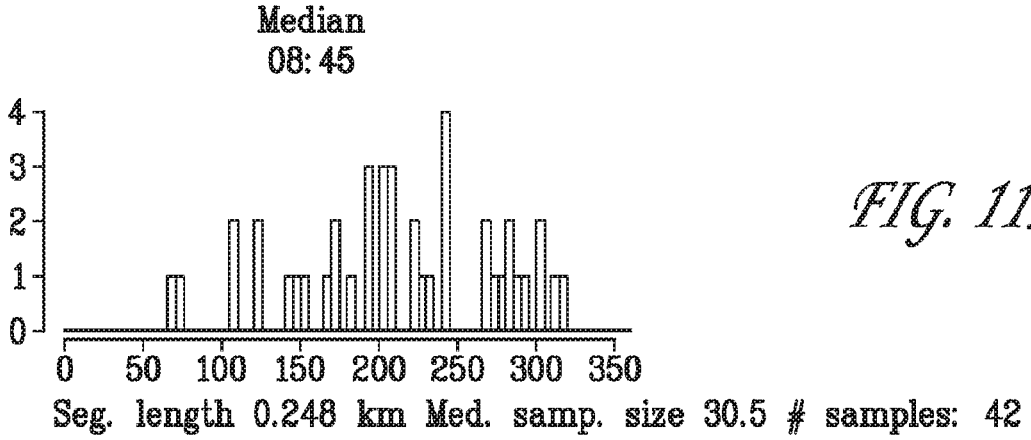
Figure 11N:
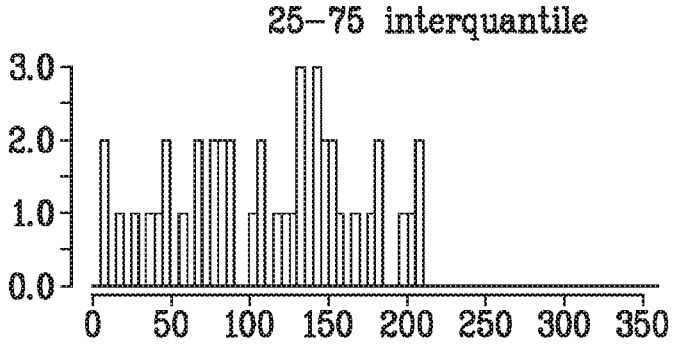
Figure 11O:
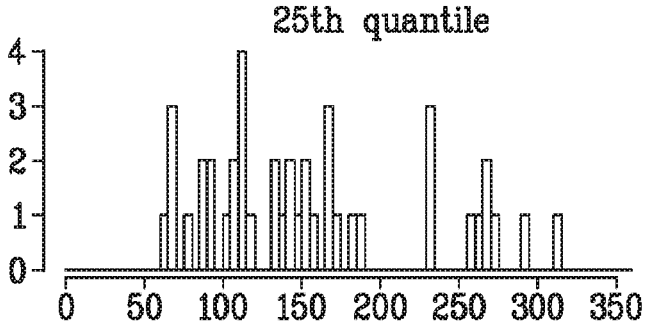
Figure 11P:
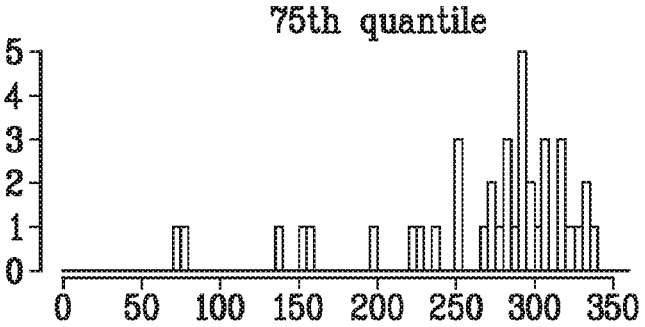

FIGS. 9A-F are another series of graphs showing the distribution of certain parameters for two consecutive time slots from approximately 30 days of data. The parameters shown may be extracted by system 100 from the individual time distributions and may include the 25th percentile, median, and 75th percentile, and determine the range of the variations contained therein. As shown in FIGS. 9A-F, system 100 may determine when certain periods of time are likely to be more congested on a signalized arterial segment. In one exemplary scenario, as shown in FIG. 9D, the median reveals seven or eight congested days at 5:15 PM (depicted as "17:15"), while FIG. 9A reveals that the traffic is relatively tamer at 5 PM (depicted as "17:00"). FIGS. 9A-F further illustrate the absolute distribution of quantiles across different days, but not necessarily the correlation between the quantile variations. FIGS. 10A-P and 11A-P are further series of graphs showing exemplary quantile distributions. As discussed below, a more comprehensive traffic estimation model may be generated by calibrating travel time distribution models from quantile values.

Figure 12A:
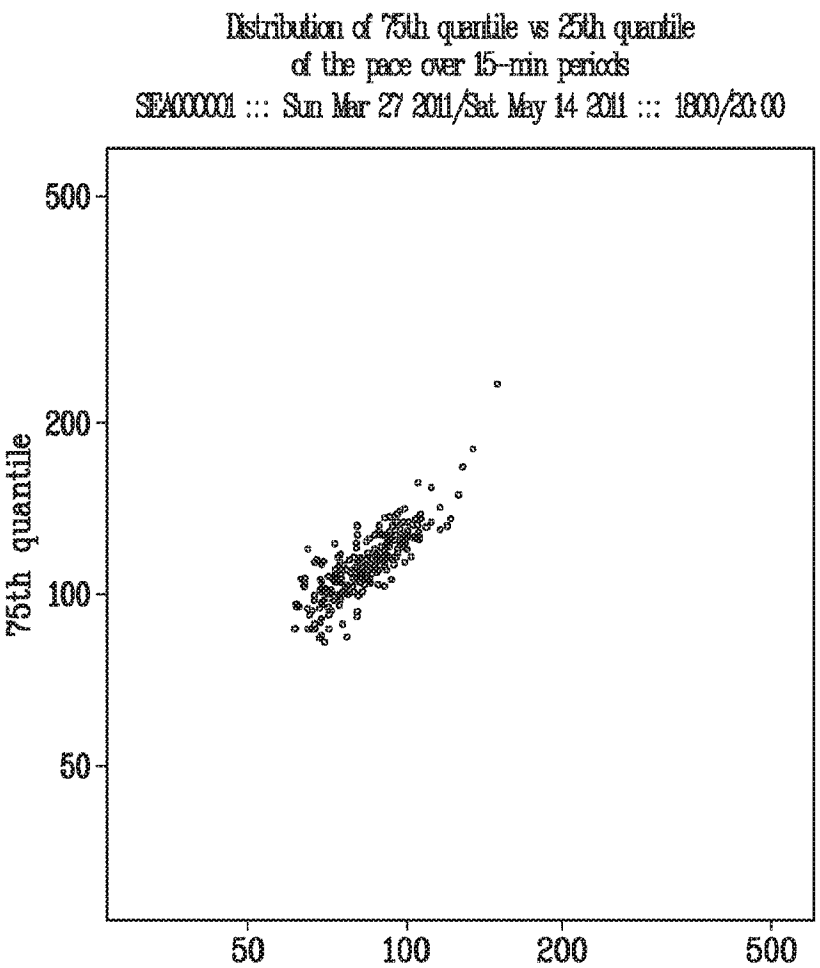
FIGS. 12A-B are a series of scatter plots mapping quantiles against one another.
Figure 12B:
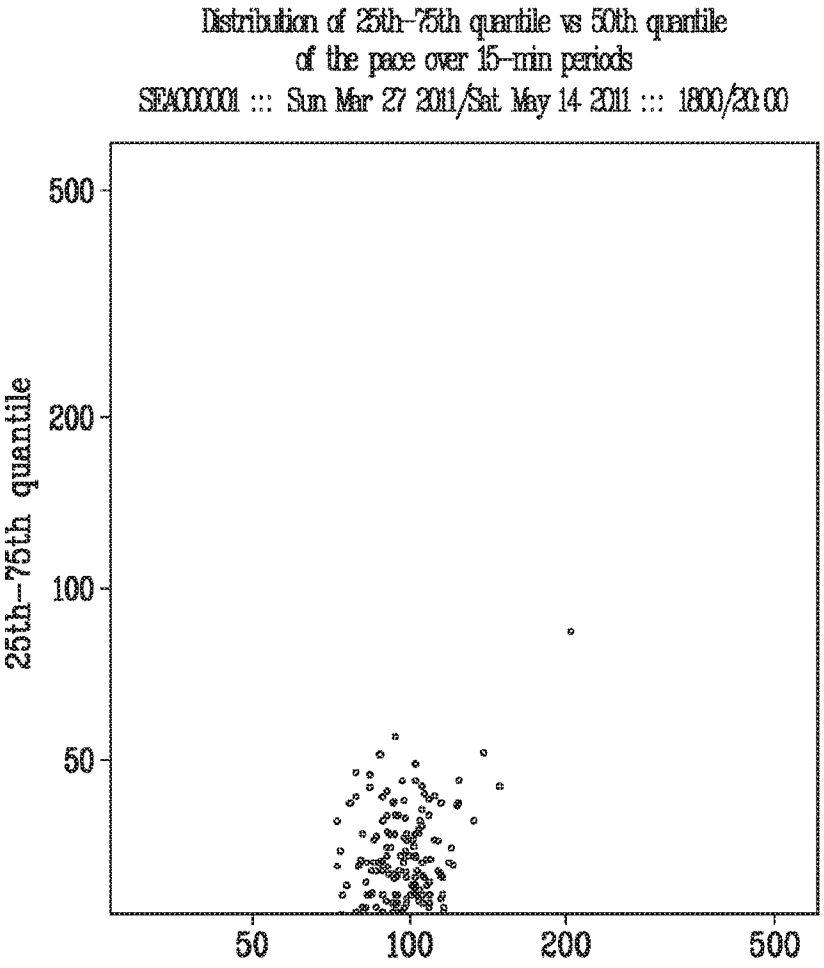

FIGS. 12A-B are a series of scatter plots mapping quantiles against one another. More specifically, FIG. 12A maps the 75th quantile against the 25th quantile, and FIG. 12B maps the 25th-75 th interquantile against the median (depicted as the "50th quantile"). FIGS. 12A-B show distributions over 30 days for a timeslot spanning 6 PM to 8 PM. Accordingly, each dot on the plots shown in FIGS. 12A-B represents a single fifteen-minute distribution of pace that took place between 6 PM and 8 PM. As shown in FIGS. 12A, system 100 may determine that the 75th and 25th appear correlated, for example being no more than 50 seconds/kilometer apart. Such results indicate that inter-vehicular travel time variations are not insignificant but remain limited. In other instances, the correlation between quantiles may be less, corresponding to more disorganized traffic conditions.

Figures 13A, 13B, 13C:
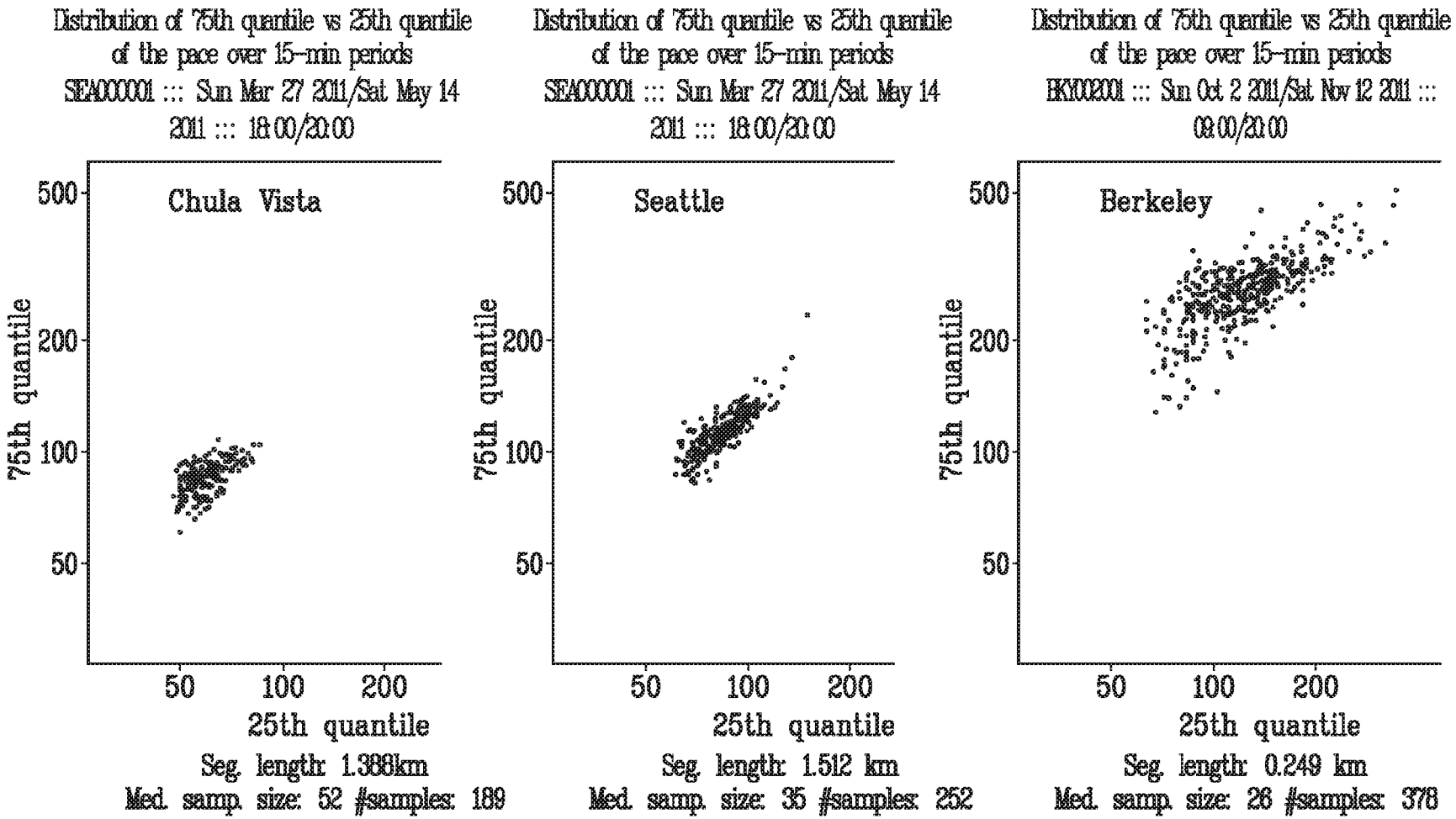
FIGS. 13A-C are another series of scatter plots mapping quantiles against one another.

FIGS. 13A-C are another series of scatter plots mapping quantiles against one another. FIGS. 13A-C map quantiles from three different locations: Chula Vista, Calif., Seattle, Wash., and Berkeley, Calif.

The system and methods disclosed herein reveal that some segments exhibit relatively little dispersion and only minor fluctuations throughout the day, while other segments seem to constantly induce delays. In some cases, travel times appear neatly distributed around a single mode. In other instances, the shape of the distribution may suggest more of a continuum. The system and methods described herein fulfill the need for a flexible model that allows different distribution shapes and can therefore provide a good to the data. To avoid being constrained by limited number of observations and low sample sizes (and posing a serious risk of over-fitting by allowing multiple dimensions for the parameter $\theta_T$), system 100 may analyze data by focusing on key percentile values as proxy descriptors for the travel time distributions. System 100 may calibrate prior distributions by analyzing density plots such as those described above over substantial periods of time. In doing so, system 100 may use universal pace distributions such that system 100 may perform Bayesian calibrations and estimations.

Figure 14:
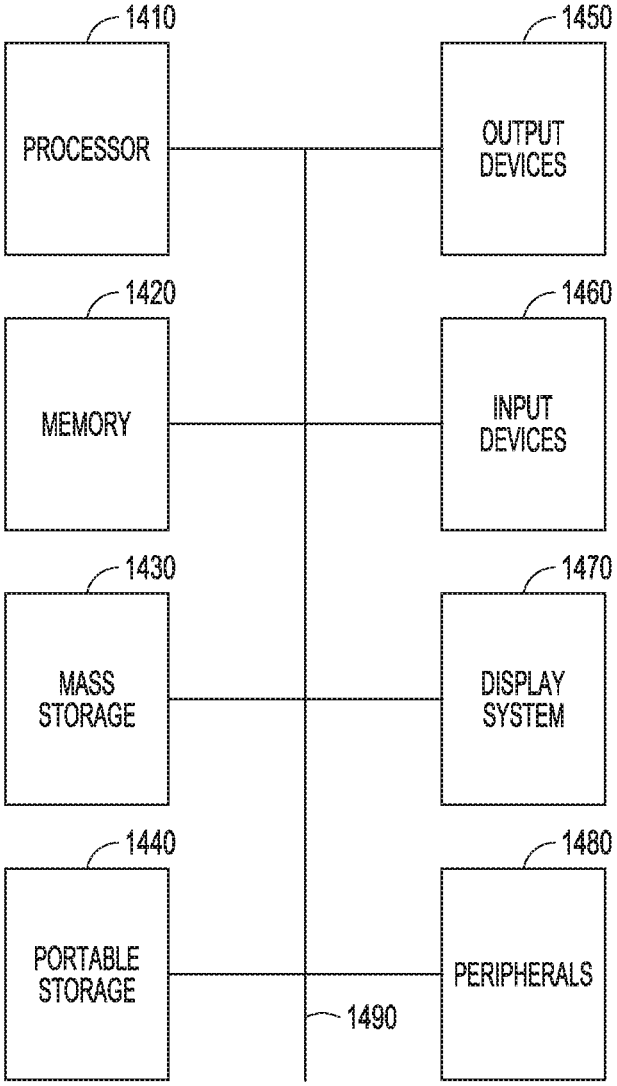
FIG. 14 is a block diagram of a device for implementing an embodiment of the presently disclosed invention.

FIG. 14 is a block diagram of a device 1400 for implementing an embodiment of the technology disclosed herein. System 1400 of FIG. 14 may be implemented in the contexts of the likes of client computer 110 and server computer 130. The computing system 1400 of FIG. 14 includes one or more processors 1410 and memory 1420. Main memory 1420 may store, in part, instructions and data for execution by processor 1410. Main memory can store the executable code when in operation. The system 1400 of FIG. 14 further includes a storage, which may include mass storage 1430 and/or portable storage 1440, output devices 1450, user input devices 1460, a display system 1470, and peripheral devices 1480. Although not shown, system 1400 may also include one or more antenna.

The components shown in FIG. 14 are depicted as being connected via a single bus 1490. The components may, however, be connected through one or more means of data transport. For example, processor unit 1410 and main memory 1420 may be connected via a local microprocessor bus, and the storage, including mass storage 1430 and/or portable storage 1440, peripheral device(s) 1480, and display system 1470 may be connected via one or more input/output (I/O) buses. In this regard, the exemplary computing device of FIG. 14 should not be considered limiting as to implementation of the technology disclosed herein. Embodiments may utilize one or more of the components illustrated in FIG. 14 as might be necessary and otherwise understood to one of ordinary skill in the art.

The storage device may include mass storage 1430 implemented with a magnetic disk drive or an optical disk drive, may be a non-volatile storage device for storing data and instructions for use by processor unit 1410. The storage device may store the system software for implementing embodiments of the system and methods disclosed herein for purposes of loading that software into main memory 1420.

Portable storage device 1440 operates in conjunction with a portable non-volatile storage medium, such as a floppy disk, compact disk or digital video disc, to input and output data and code to and from the computer system 1400 of FIG. 14. The system software for implementing embodiments of the system and methods disclosed herein may be stored on such a portable medium and input to the computer system 1400 via the portable storage device.

Antenna 440 may include one or more antennas for communicating wirelessly with another device. Antenna 440 may be used, for example, to communicate wirelessly via Wi-Fi, Bluetooth, with a cellular network, or with other wireless protocols and systems including but not limited to GPS, A-GPS, or other location based service technologies. The one or more antennas may be controlled by a processor 1410, which may include a controller, to transmit and receive wireless signals. For example, processor 1410 execute programs stored in memory 412 to control antenna 440 transmit a wireless signal to a cellular network and receive a wireless signal from a cellular network.

The system 1400 as shown in FIG. 14 includes output devices 1450 and input device 1460. Examples of suitable output devices include speakers, printers, network interfaces, and monitors. Input devices 1460 may include a touch screen, microphone, accelerometers, a camera, and other device. Input devices 1460 may include an alpha-numeric keypad, such as a keyboard, for inputting alpha-numeric and other information, or a pointing device, such as a mouse, a trackball, stylus, or cursor direction keys.

Display system 1470 may include a liquid crystal display (LCD), LED display, or other suitable display device. Display system 1470 receives textual and graphical information, and processes the information for output to the display device.

Peripherals 1480 may include any type of computer support device to add additional functionality to the computer system. For example, peripheral device(s) 1480 may include a modem or a router.

The components contained in the computer system 1400 of FIG. 14 are those typically found in computing system, such as but not limited to a desk top computer, lap top computer, notebook computer, net book computer, tablet computer, smart phone, personal data assistant (PDA), or other computer that may be suitable for use with embodiments of the technology disclosed herein and are intended to represent a broad category of such computer components that are well known in the art. Thus, the computer system 1400 of FIG. 14 can be a personal computer, hand held computing device, telephone, mobile computing device, workstation, server, minicomputer, mainframe computer, or any other computing device. The computer can also include different bus configurations, networked platforms, multiprocessor platforms, etc. Various operating systems can be used including Unix, Linux, Windows, Macintosh OS, Palm OS, and other suitable operating systems.

Figure 15:
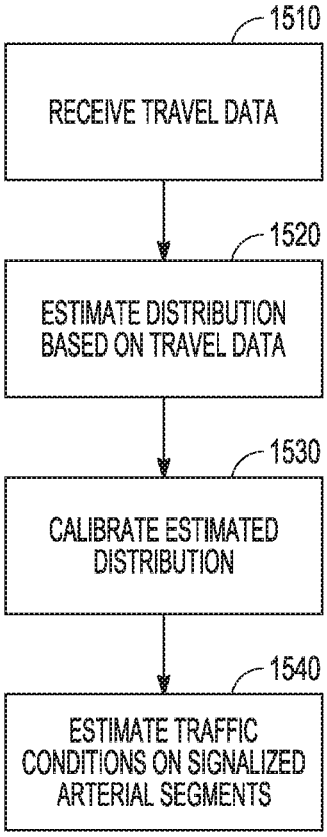
FIG. 15 shows an exemplary method for estimating traffic on signalized arterials.

FIG. 15 shows an exemplary method for estimating traffic on signalized arterials. In an embodiment, method 1500 may include receiving travel data at step 1510. As noted above, travel data may be received from mobile GPS devices, reidentification technologies, or from a third-party server that pre-collected data. Method 1500 may further include executing instructions stored in memory, wherein execution of the instructions by a computer processor estimates a distribution based on the traffic data. At step 1530, execution of the instructions by a processor may further calibrate the distribution estimated in step 1520. In some embodiments, at step 1540, method 1500 may further include estimating the traffic conditions on a particular arterialized segment at a particular time based on the calibrated distribution. Method 1500 may also include displaying the estimated traffic conditions through a graphical interface, such as on a mobile device belonging to a user. Method 1500 of FIG. 15 may be implemented by system 100 of FIG. 1.

As discussed above, the system disclosed herein builds historical knowledge about traffic conditions by accumulating measurements over time. The system then calibrates model for different times of the day and updates those models with current available data. In some embodiments, system 100 may utilize several thousands of data plots. Moreover, as discussed above, system 100 may utilize three different sources of variability: individual, daily, and day-to-day. In situations where no current data is available, the historical data alone may be used. In situations in which current data is available, such as data received by system 100 from reidentification devices, system 100 may update the historical knowledge accordingly using the Bayesian interface discussed above. In some embodiments, quantile maps like those discussed above may be utilized to accomplish such estimations.

The foregoing detailed description of the technology herein has been presented for purposes of illustration and description. It is not intended to be exhaustive or to limit the technology to the precise form disclosed. Many modifications and variations are possible in light of the above teaching. The described embodiments were chosen in order to best explain the principles of the technology and its practical application to thereby enable others skilled in the art to best utilize the technology in various embodiments and with various modifications as are suited to the particular use contemplated. It is intended that the scope of the technology be defined by the claims appended hereto.

What is claimed is:

1. A system for estimating time travel distributions on signalized arterials, comprising:

a processor;

memory; and an application stored in memory and executable by the processor to perform operations comprising:

receiving travel data from one or more re-identification devices;

estimating a first distribution on one or more signalized arterials based on the received travel data. the first distribution comprising a linear combination of individual paces weighed by distance traveled;

calibrating the first distribution to obtain a second distribution, the second distribution being a more recent estimate of travel time compared to the first distribution;

estimating a traffic conditions on a particular arterialized segment, of the one or more signalized arterials, at a particular time based on the second distribution; and causing the traffic condition to be displayed through a graphical interface being displayed on a device.

2. The system of claim 1, wherein the re-identification device is a magnetic signature.

3. The system of claim 1, wherein the re-identification device is a toll tag.

4. The system of claim 1, wherein the re-identification device is a license plate.

5. The system of claim 1, wherein the re-identification device is a Bluetooth receiver.

6. The system of claim 1, wherein the received travel data includes travel time observation of the one or more signalized arterials of interest.

7. The system of claim 1, wherein the received travel data includes travel time observation of one or more nearby signalized arterials to the one or more signalized arterials of interest.

8. The system of claim 1, wherein the received travel data includes contextual evidence associated with the one or more signalized arterials of interest.

9. The system of claim 1, wherein the operations further comprise incorporating travel time variability components with the first distribution.

10. The system of claim 9, wherein the travel time variability components include at least one of individual variations, time-of-day variations, or daily variations.

11. A method for estimating time travel distributions on signalized arterials, comprising:

receiving travel data from one or more re-identification devices;

estimating a first distribution on one or more signalized arterials based on the received travel data, the first distribution comprising a linear combination of individual paces weighed by distance traveled;

calibrating the first distribution to obtain a second distribution, wherein the second distribution being a more recent estimate of travel time compared to the first distribution;

estimating a traffic conditions on a particular arterialized segment, of the one or more signalized arterials, at a particular time based on the second distribution; and causing the traffic condition to be displayed through a graphical interface being displayed on a device.

12. The method of claim 11, wherein the re-identification device is a magnetic signature.

13. The method of claim 11, wherein the re-identification device is a toll tag.

14. The method of claim 11, wherein the re-identification device is a license plate.

15. The method of claim 11, wherein the re-identification device is a Bluetooth receiver.

16. The method of claim 11, wherein the received travel data includes travel time observation of the one or more signalized arterials of interest.

17. The method of claim 11, wherein the received travel data includes travel time observation of one or more nearby signalized arterials to the one or more signalized arterials of interest.

18. The method of claim 11, wherein the received travel data includes contextual evidence associated with the one or more signalized arterials of interest.

19. The method of claim 11, further comprising incorporating travel time variability components with the first distribution.

* * * * *